US005809153A

United States Patent [19]

Aylward et al.

[11] Patent Number: 5,809,153

[45] Date of Patent: Sep. 15, 1998

[54] ELECTROACOUSTICAL TRANSDUCING

[75] Inventors: J. Richard Aylward, Ashland; Timothy Holl, Medway; William P. Schreiber, Ashland, all of Mass.

[73] Assignee: Bose Corporation, Framingham, Mass.

[21] Appl. No.: 760,349

[22] Filed: Dec. 4, 1996

[51] Int. Cl.[6] ..... H04R 1/02; H04R 25/00

[52] U.S. Cl. ..... 381/155; 381/160; 381/188; 381/80; 381/90; 381/153

[58] Field of Search ..... 381/155, 188, 381/82, 94.7, 94.3, 97, 98, 99, 102, 104, 153, 160, 192, 205, 198, 80, 90; 181/198, 199, 185

[56] References Cited

U.S. PATENT DOCUMENTS

| | | | |
|---|---|---|---|
| 2,301,744 | 11/1942 | Olson | 381/155 |
| 4,051,919 | 10/1977 | Buettner | 181/144 |
| 4,133,975 | 1/1979 | Barker | 181/144 |
| 4,179,585 | 12/1979 | Herrenschmidt | 181/147 |
| 4,503,553 | 3/1985 | Davis | 381/24 |
| 4,805,221 | 2/1989 | Quaas | 381/154 |
| 4,860,363 | 8/1989 | Suzuki et al. | 381/89 |
| 4,882,760 | 11/1989 | Yee | 381/90 |
| 4,885,782 | 12/1989 | Eberbach | 381/186 |
| 5,210,802 | 5/1993 | Aylward | 381/61 |
| 5,212,732 | 5/1993 | Hipps et al. | 381/188 |
| 5,228,085 | 7/1993 | Aylward | 381/24 |
| 5,309,518 | 5/1994 | Ickler et al. | 381/188 |
| 5,448,647 | 9/1995 | Koizumi | 381/90 |
| 5,557,680 | 9/1996 | Janes | 381/188 |
| 5,621,804 | 4/1997 | Beppu | 381/90 |

*Primary Examiner*—Wing F. Chan
*Assistant Examiner*—Rexford N. Barnie
*Attorney, Agent, or Firm*—Fish & Richardson P.C.

[57] ABSTRACT

Electroacoustical transducing apparatus includes an input for receiving an audio electrical signal. A first electroacoustical transducer is constructed and arranged to radiate first sound waves in a first direction in a first frequency range in response to an audio electrical signal on the input. A second electroacoustical transducer is constructed and arranged to radiate sound energy in a second direction in a second frequency range. A third electroacoustical transducer is constructed and arranged to radiate sound energy in a third direction within the second frequency range. Intercoupling circuitry intercouples the input with the second transducer and the third transducer and is constructed and arranged to cause the second transducer and the third transducer to radiate sound energy in the second and third directions in response to an audio electrical signal on the input relatively phased with respect to energy radiated in the second frequency range by the first transducer in the second and third directions in phase opposition therewith to oppose radiation in second and third directions from the first transducer within the second frequency range, the first frequency range being greater than and embracing the second frequency range.

44 Claims, 28 Drawing Sheets

FRONT

BACK

ELECTROACOUSTICAL TRANSDUCING

The present invention relates in general to electroacoustical transducing, and more particularly to compact loudspeaker systems that radiate sound waves in a predetermined pattern to create a realistic acoustic image of the sound source being transduced.

BACKGROUND OF THE INVENTION

For background, reference is made to U.S. Pat. Nos. 4,503,553 and 5,210,802 and an article entitled "Stereophonic Projection Console" in IRE Transactions on Audio Vol. AU-8, No. 1, pp. 13–16 (January/February 1996).

It is an important object of the invention to provide improved electroacoustical transducing.

SUMMARY OF THE INVENTION

According to the invention, a loudspeaker system includes an input for receiving an audio electrical signal; a first transducer facing a first direction, coupled to the input for radiating first sound waves in a first frequency range; a second transducer facing a second direction for radiating second sound waves; and a third transducer facing a third direction for radiating third sound waves. A low pass filter couples the input to the second transducer and the third transducer, and provides a modified audio electrical signal to the second transducer and to the third transducer. A delay network delays the radiating of the second sound waves and the third sound waves so that they are in substantial opposition with that portion of the first sound waves radiated in the second and third directions providing substantial cancellation of the first sound waves in the second and third directions.

In another aspect of the invention, a directional loudspeaker system, includes a first loudspeaker having a substantially dipole sound radiation pattern in a first frequency range and a second loudspeaker having a substantially omnidirectional sound radiation pattern in the first frequency range. The first loudspeaker and the second loudspeaker are arranged to cumulatively and differentially combine radiation in first and second directions, respectively.

In another aspect of the invention, a multichannel audio reproduction apparatus includes an enclosure, a first input for receiving a first audio electrical signal, and a first transducer in the enclosure coupled to the first input for radiating first sound waves, a second transducer in the enclosure for radiating second sound waves, a first signal modifier coupling the first input to the second transducer constructed and arranged so that the second sound waves oppose the first sound waves in a first direction, a second input for receiving a second audio electrical signal, a third transducer in the enclosure coupled to the second input for radiating third sound waves, a fourth transducer in the enclosure for radiating fourth sound waves, and a second signal modifier coupling the second input to the fourth transducer constructed and arranged so that the fourth sound waves oppose the second sound waves in a second direction.

In still another aspect of the invention a multichannel audio reproduction system includes a first input for receiving a first audio electrical signal coupled to a first transducer for radiating first sound waves and a second input for receiving a second audio electrical signal coupled to a second transducer for radiating second sound waves, a first signal modifier coupling the first input to a third transducer and a second signal modifier coupling the second input to the third transducer constructed and arranged so that the third transducer radiates third sound waves that significantly oppose in a first direction, the first sound waves and the second sound waves.

Other features, objects and advantages will become apparent from the following detailed description when read in connection with the accompany drawings in which:

DETAILED DESCRIPTION

Figure 1:
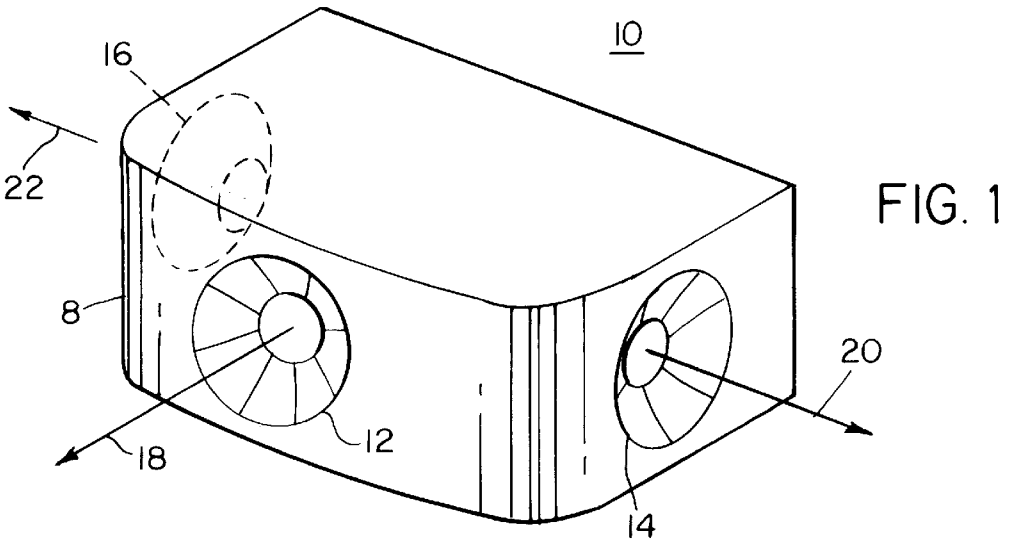
FIG. 1 is an isometric view of a loudspeaker system according to the invention.

The same reference symbols identify corresponding elements throughout the drawings. With reference now to the drawings and more particularly to FIG. 1, there is shown an isometric view of a loudspeaker unit 10 in accordance with the invention. A housing or enclosure 8 supports three electroacoustical transducers or loudspeaker drivers 12, 14, 16 facing directions 18, 20 and 22, respectively.

Figure 2:
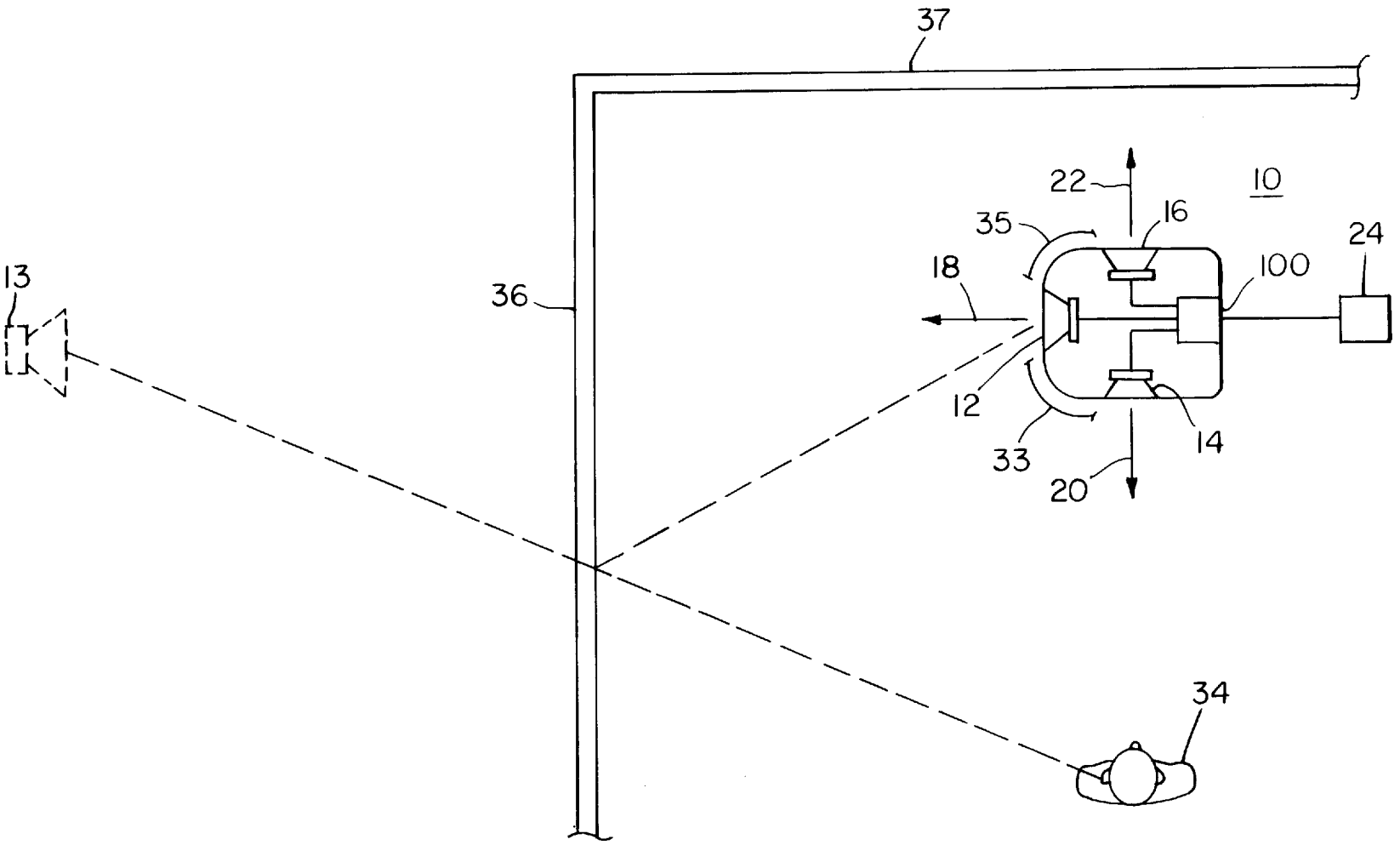
FIG. 2 is a diagrammatic view of the loudspeaker system of FIG. 1 in an audio reproduction system in a room.

Referring to FIG. 2, there is shown a diagrammatic representation of the loudspeaker unit 10 of FIG. 1 in an audio reproduction system in a room. First driver 12 is in substantial space quadrature with second driver 14 and third driver 16 and separated from each by paths 33 and 35, respectively, of lengths $l_1$ and $l_2$, respectively.

Audio signal source 24 transmits audio electrical signals to electroacoustical transducers 12, 14, 16 to radiate corresponding sound waves. Network 100 modifies the signals sent to the transducers to control the pattern of sound waves radiated by the combination of transducers 12, 14, 16 to produce desired sound fields. In one embodiment, network 100 modifies the signals such that the radiation pattern of loudspeaker unit 10 is strongly directional in direction 18.

In operation, audio signal source 24 transmits an audio signal through network 100 to first transducer 12, second transducer 14, and third transducer 16 which radiate sound waves. Network 100 modifies the time and amplitude characteristics of the audio signal such that when a sound wave radiated by first transducer 12 arrives at second transducer 14, second transducer 14 radiates a sound wave out of phase with and of similar amplitude to the sound wave arriving from first transducer 12. The result is that in direction 20, the sound wave radiated by second transducer 14 significantly opposes the sound wave radiated from first transducer 12. Similarly, network 100 modifies the audio signal such that when a sound wave radiated by first transducer 12 reaches third transducer 16, third transducer 16 radiates a sound wave out of phase with and of similar amplitude to the sound wave arriving from first transducer 12. The result is that in direction 22, the sound wave radiated by third transducer 16 significantly opposes the sound wave radiated from first transducer 12. Since the sound waves arriving from first transducer 12 are significantly opposed in directions 20 and 22, the radiation from the loudspeaker unit is strongly directional in direction 18. It is convenient to define a transducer that radiates sound in a direction in which a loudspeaker unit is directional as a "primary transducer" and a transducer that radiates sound waves that oppose sound waves radiated by a primary transducer as a "bucking transducer." A single transducer may be both a primary transducer and a bucking transducer, and one bucking transducer may oppose sound waves radiated by more than one primary transducer.

In the embodiment of FIG. 2, the acoustic path of the sound waves radiated in direction 18 and reflecting off an acoustically reflecting surface 36 to a listener 34 in an intended listening position is longer, and therefore, later arriving than the sound waves arriving directly from other sources (such as directly from transducers 12, 14, 16). However, by producing sound waves radiated in direction 18 and reflecting off the acoustically reflecting surface 36 of significantly greater amplitude (on the order of 10 dB), the listener 34 perceives the source of the sound according to accepted psychoacoustic criteria as being one or more "virtual sources" in the general direction of the reflecting surface 36, creating an expanded perceived sound image. The virtual sources may be behind the reflecting surface (i.e, between reflecting surface 36 and position 13), or at a position between loudspeaker unit 10 and reflecting surface 36. This perception, or localization, of "virtual source" toward reflecting surfaces instead of at the sound source is an advantage of the invention.

Figure 3:
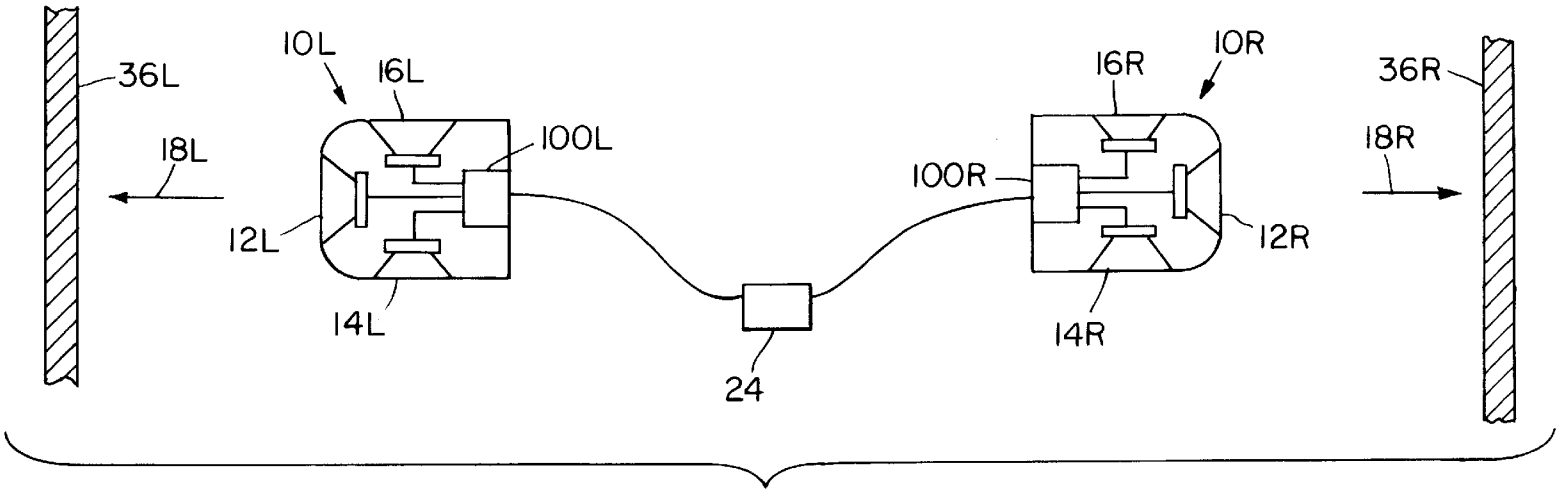
FIG. 3 is a diagrammatic view of a second embodiment of a loudspeaker system according to the invention.

Referring to FIG. 3, there is shown a loudspeaker system including two loudspeaker units constructed in accordance with the principles of the embodiment of FIG. 2. A stereophonic signal source 24 delivers left and right signals to left loudspeaker unit 10L and right loudspeaker unit 10R, respectively, through networks 100L and 100R, respectively. Loudspeaker units 10L and 10R each may have electroacoustical transducers (12L, 14L, 16L and 12R, 14R, 16R, respectively) similar to loudspeaker unit 10 of FIG. 2.

Loudspeaker units 10L and 10R radiate sound in directions indicated by arrows 18L and 18R, respectively, according to the operational principles outlined in the discussion of FIG. 2. The sound radiated by loudspeaker systems 10L and 10R reflect off acoustically reflective surfaces 36L and 36R, respectively, and produce the perception to a listener of having been radiated by "virtual sources" located in the direction of reflective surfaces 36L and 36R as discussed above in the discussion of FIG. 2. The location of the "virtual sources" can be changed by changing the distance between loudspeaker units 10L, and 10R and the acoustically reflective surfaces 36L and 36R, or by changing the orientation of the loudspeaker units relative to the acoustically reflective surface. A loudspeaker system according to FIG. 3 is advantageous, because it allows the placement of "virtual sources" at locations at which it would be impractical or impossible to physically place a loudspeaker. Additionally, a loudspeaker system according to FIG. 3 can create a perceived sound image larger than the room in which the loudspeaker is placed because the first reflections from the acoustically reflective surfaces 36L and 36R may appear to have been radiated by a virtual source beyond the acoustically reflecting surfaces 36L and 36R.

Figure 4:
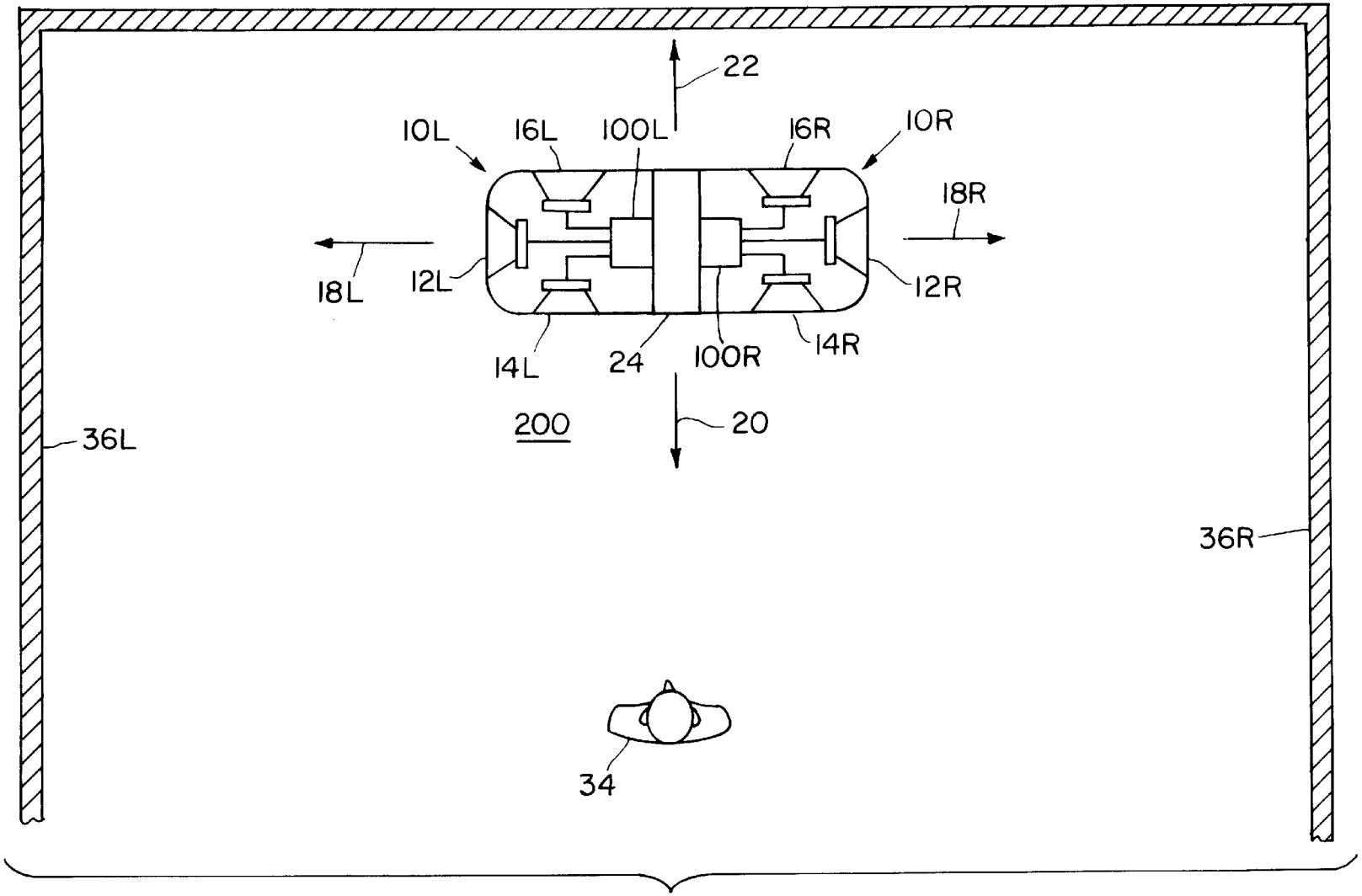
FIG. 4 is a diagrammatic view of a third embodiment of a loudspeaker system in a room according to the invention.

Referring to FIG. 4, there is shown an alternate embodiment of the loudspeaker system of FIG. 3. System 200 includes stereophonic signal source 24 coupled to loudspeaker units 10L and 10R through networks 100L and 100R, respectively, in a single enclosure. The system of FIG. 4 has the same elements as the system of FIG. 3 (some not shown in this view). A system according to FIG. 4 is advantageous because it provides a perceived sound image width as good or better than many stereophonic systems with two widely separated speakers typically located apart from the stereophonic signal source. When system 200 is operated in accordance with the principles of the embodiment of FIG. 3, the radiation patterns of left loudspeaker unit 10L and right loudspeaker unit 10R have maxima in directions 18L and 18R, respectively. The sound waves radiated in directions 18L and 18R and reflected to listener 34 in an intended listening position off acoustically reflecting surfaces 36L and 36R, respectively, have amplitudes significantly greater than the sound waves radiated directly to the listener by transducers 12L, 14L, 16L, 12R, 14R and 16R. The listener 34 perceives the sound emanating from virtual sources in the direction of reflecting surfaces 36L and 36R as discussed above in the discussion of FIG. 2.

Figure 5:
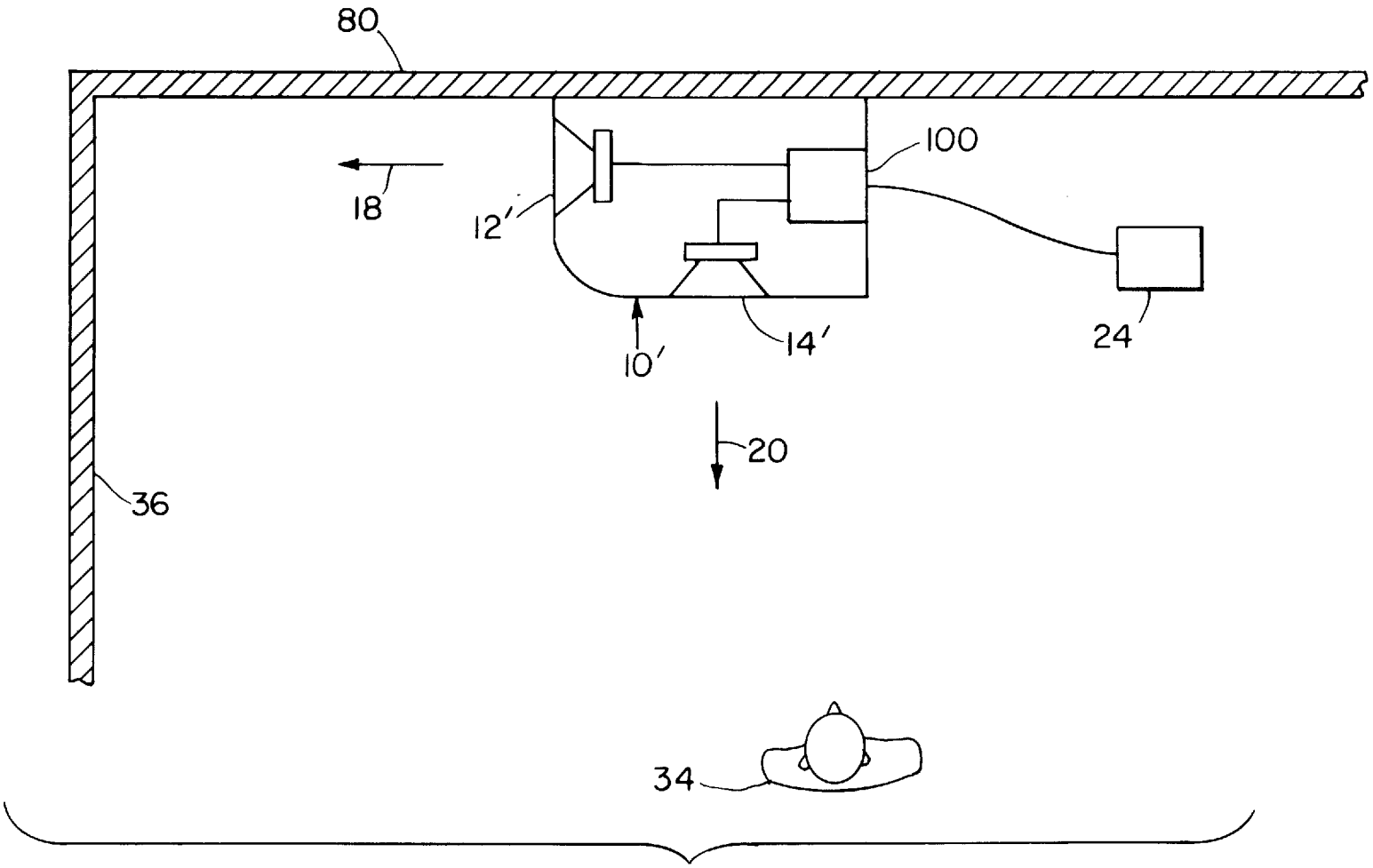
FIG. 5 is a diagrammatic view of a fourth embodiment of a loudspeaker system in a room according to the invention.

Referring to FIG. 5, there is shown an alternate embodiment of the loudspeaker unit of FIG. 2, adapted for a situation in which it is not necessary to oppose sound waves radiated in a direction opposite the intended listening position. Examples may include a loudspeaker system for mounting on a wall, or a loudspeaker system mounted in a cabinet, such as a television console. A loudspeaker unit 10' includes a first electroacoustical transducer 12' facing the direction indicated by arrow 18 and a second electroacoustical transducer 14' facing orthogonally to the first transducer 12', in the direction indicated by arrow 20. An audio signal source 24' is coupled to first transducer 12' and second transducer 14' through a network 100' that modifies the signal from signal source 24' in a manner similar to network 100 of FIG. 2. As a result, the sound waves radiated from first transducer 12 are opposed in direction 20 by sound waves radiated by second transducer 14. Sound waves radiated in direction 18 and reflected off acoustically reflecting surface 36 to listener 34 in an intended listening position are significantly louder than sound waves radiated directly to listener 34. This reflected energy creates a "virtual source" in the direction of the acoustically reflecting surface 36. The embodiment of FIG. 5 is advantageous when loudspeaker unit 10' is near wall 80. A similar configuration can be used if wall 80 is replaced by a cabinet, such as a television console as can be seen, the axis of first transducer 12' intersects the axis of second transducer 14' at an angle significantly different from 180°. The embodiment of FIG. 5 can be implemented as a stereo system by combining the principles disclosed in the discussion of FIGS. 3, 4 and 5.

Figure 6A:
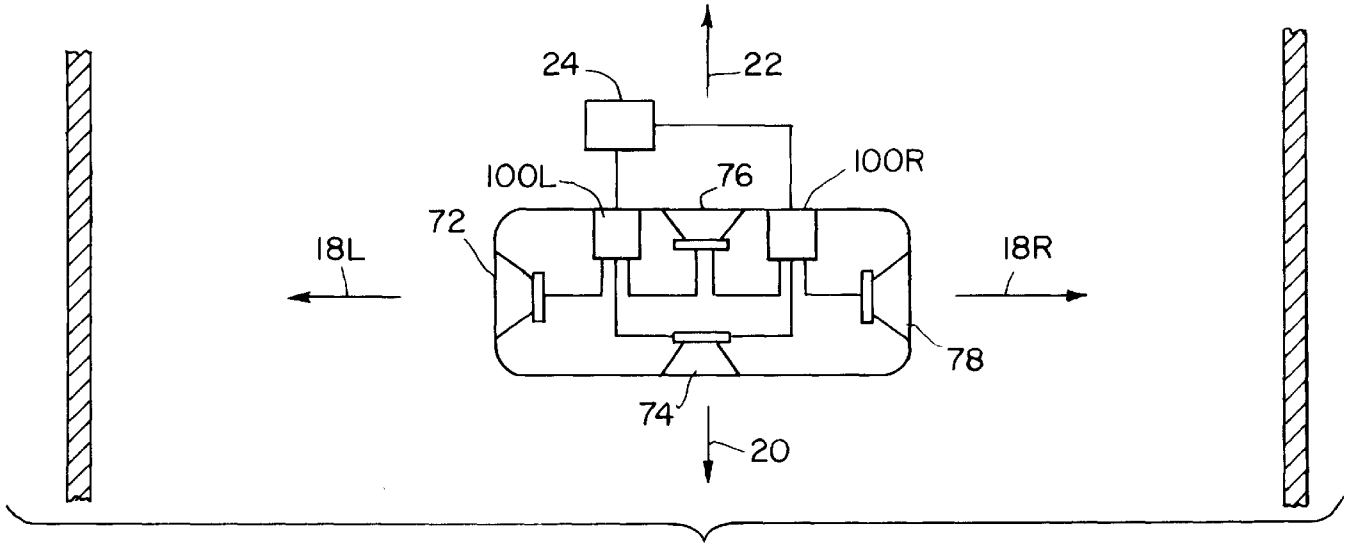
FIGS. 6*a* and 6*b* are diagrammatic views of a fifth embodiment of a loudspeaker system according to the invention.

Referring now to FIG. 6*a,* there is shown an alternate embodiment of the loudspeaker system shown in FIG. 3. The left channel of stereophonic signal source 24 is coupled to a first transducer 72, a second transducer 74, and a third transducer 76 by a left network 100L. Similarly, the right channel of stereophonic signal source 24 is coupled to a fourth transducer 78 through right network 100R.

In operation, stereophonic signal source 24 transmits a left channel signal to first transducer 72 and to the second and third transducers 74 and 76 through network 100L. Network 100L modifies the signal so that the sound waves radiated by second and third transducers 74 and 76 oppose the sound waves arriving from first transducer 72 in a manner similar to the embodiment of FIG. 2. The result is a left channel sound field that is directional in direction 18L faced by first transducer 72. Similarly, stereophonic signal source 24 transmits a right channel signal to fourth transducer 78 and to second and third transducers 74 and 76 through network 100R. Network 100R modifies the signal so that the sound waves radiated by second and third transducers 74 and 76 oppose the sound waves arriving from fourth transducer 78 in a manner similar to the embodiment of FIG. 2. The result is a right channel sound field that is directional in direction 18R faced by fourth transducer 78. In this embodiment, the second and third transducers 74, 76 serve to oppose sound waves arriving from both first transducer 72 and fourth transducer 78. As in the embodiment of FIG. 4, the left and right channels appear to be radiated from virtual sources in the direction of acoustically reflecting surfaces 36L and 36R, respectively.

Figure 6B:
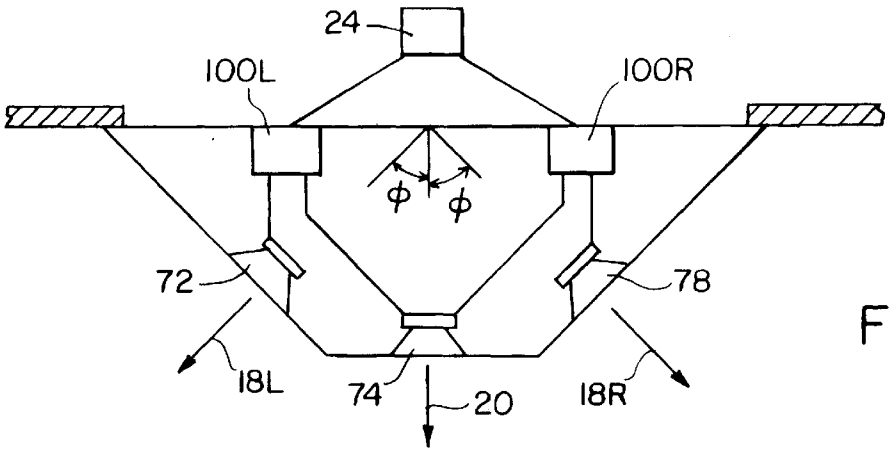

Referring now to FIG. 6*b,* there is shown an alternate configuration of the embodiment of FIG. 6*a,* combining aspects of the embodiments of FIGS. 4,5 and 6*a*. In this and other embodiments, radiation directions of the primary transducers (in this view transducers 72 and 78) are oriented at acute angles $\phi_1$ and $\phi_2$ (relative to the axis of the bucking transducer 74) but could be in substantially space quadrature with this axis as in the other embodiments. As with the embodiment of FIG. 4, this configuration is particularly well suited to a situation in which the loudspeaker unit is mounted on a wall or in a cabinet, such as a television console. Additionally, the embodiment of FIG. 6*b* could be readily adapted to radiating two channels of a multichannel system, as described below in the discussion of FIGS. 7*a*–7*b* and 8*a*–8*c*.

Figure 7A:
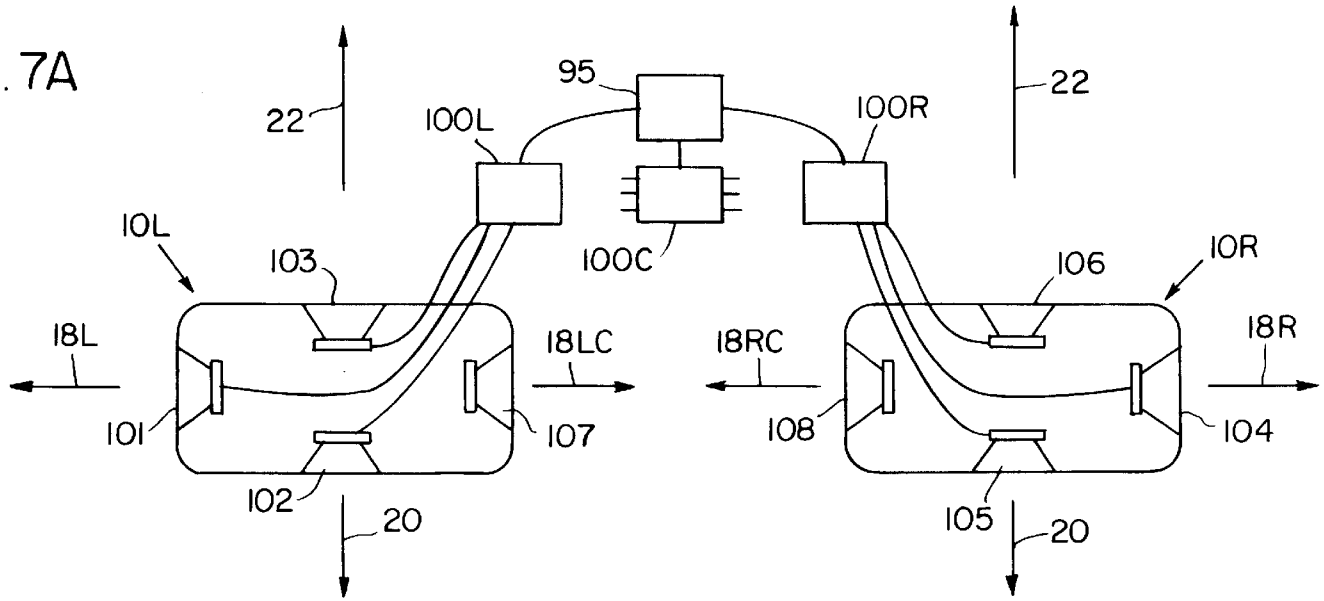
FIGS. 7*a* and 7*b* collectively illustrate a sixth embodiment of a loudspeaker system according to the invention.
Figure 7B:
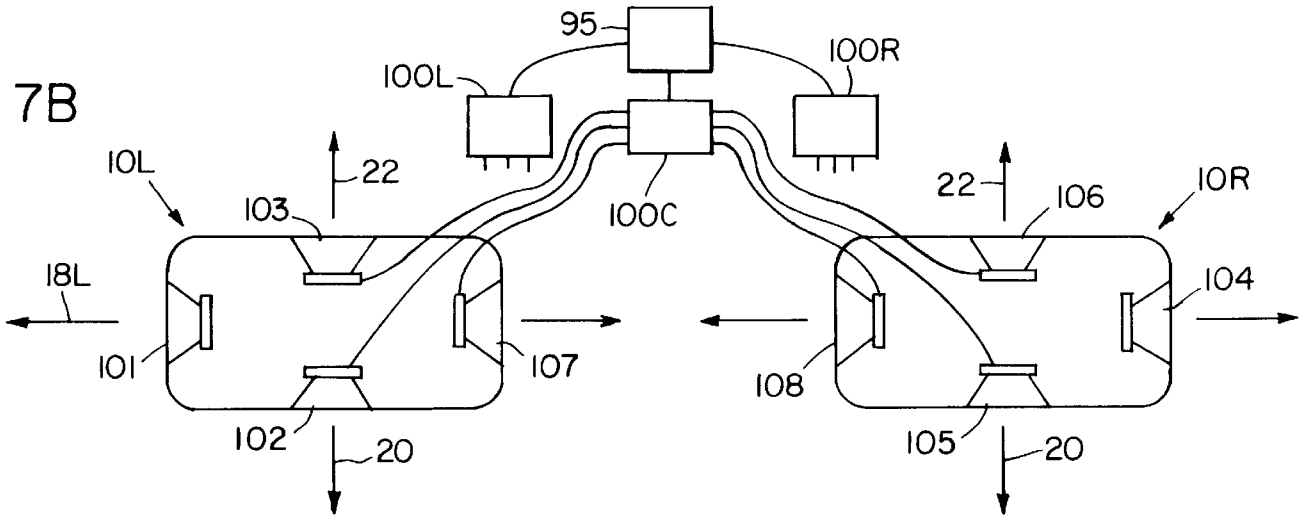

Referring now to FIGS. 7*a*–7*b,* there is shown another embodiment of the invention. For purposes of clarity, the couplings among the elements are shown in two separate figures. The left channel of a multichannel audio signal source 95 is coupled to first, second and third transducers 101, 102, 103 by a left channel network 100L as shown in FIG. 7*a*. The right channel of multichannel audio signal source 95 is coupled to first, second and third transducers 104, 105, 106 as shown in FIG. 7*a*. The center channel of multichannel audio signal source 95 is coupled to the second, third, fifth, sixth transducers 102, 103, 105, 106, respectively, and to seventh and eighth transducers 107, 108 through a center channel network 100C as shown in FIG. 7*b*. The first, second, third and seventh transducers 101, 102, 103 and 107 are in a first loudspeaker unit 10L and the fourth, fifth, sixth and eighth transducers 104, 105, 106, and 108 are in a second loudspeaker unit 10R.

With regard to sound waves radiated in response to the left channel signal (hereinafter "left channel sound waves") in a manner similar to that described above in connection with FIG. 2, left channel sound waves radiated by second and third transducers 102, 103, substantially oppose left channel sound waves radiated from first transducer 101 in directions 20 and 22 faced by second and third transducers 102, 103, respectively, so that left channel sound waves are radiated substantially directionally in the direction 18L faced by first transducer 101. With regard to sound waves radiated in response to the center channel signal (hereinafter "center channel sound waves"), center channel sound waves radiated by first and seventh transducers 101, 107 oppose the center channel sound waves radiated from second transducer 102 in directions 18L and 18LC. Similarly, center channel sound waves radiated by the fourth and eighth transducers 104, 108 oppose the sound waves radiated from fifth transducer 105 in directions 18RC, 18R faced by the fourth and eighth transducers 104, 108. Therefore, center channel sound waves are radiated substantially directionally in direction 20 faced by second transducer 102 and fifth transducer 105. With regard to sound waves radiated in response to the right channel signal (hereinafter "right channel sound waves"), right channel sound waves radiated by fifth and sixth transducers 105, 106 oppose the right channel sound waves arriving from fourth transducer 104, so that the right channel sound waves are radiated substantially directionally in the direction 18R faced by fourth transducer 108. The result is that the left channel sound waves appear to originate at a virtual source in the direction of a left acoustically reflecting surface 36L, the right channel sound waves appear to originate at a virtual source in the direction of the right reflecting surface 36R, and the center channel sound waves appear to originate at a virtual source between loudspeaker units 10L and 10R. The embodiment of FIGS. 7*a* and 7*b* could be modified so that the center channel radiates directionally in directions 18LC and 18RC. The embodiments of FIGS. 7*a* and 7*b* may be useful as a component of a multichannel system in which one of the channels is a center channel or is monophonic.

Figure 8A:
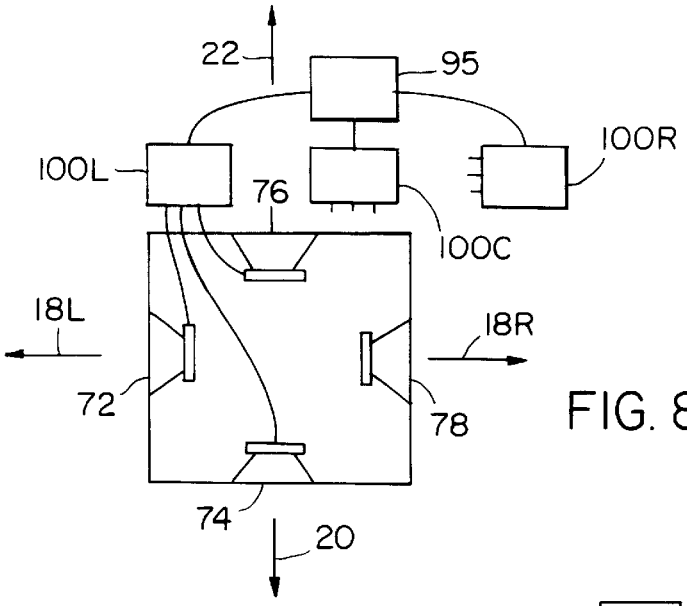
FIGS. 8*a,* 8*b* and 8*c* collectively illustrate a seventh embodiment of a loudspeaker system according to the invention.
Figure 8B:
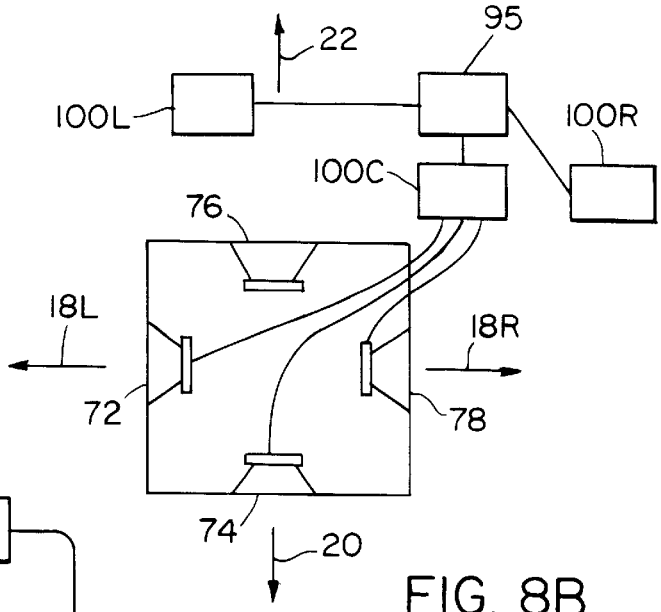
Figure 8C:
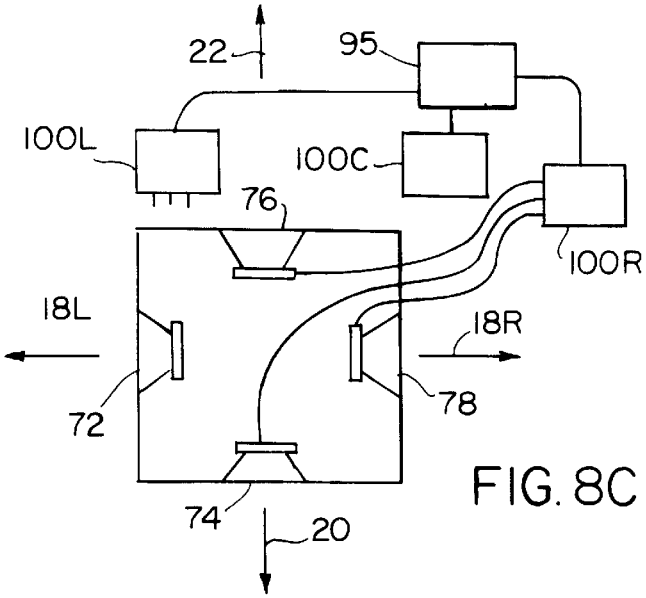

Referring to FIGS. 8*a*–8*c,* there is shown an alternate embodiment of the multichannel system of FIGS. 7*a*–7*b*. For purposes of clarity the couplings among elements of the left, right and center channels are shown in three separate figures. The left channel of a multichannel signal source 95 is coupled to first transducer 72, second transducer 74 and third transducer 76 by left channel network 100L as shown in FIG. 8*a*. The center channel of the multichannel signal source 95 is coupled to first transducer 21, second transducer 74 and fourth transducer 78 by center channel network 100C as shown in FIG. 8*b*. The right channel of the multichannel signal source 95 is coupled to second transducer 74, third transducer 76, and fourth transducer 78 by right channel network 100R.

First, second and third transducers 72, 74, 76 operate in a manner similar to transducers 101, 102, 103 of FIGS. 7*a* and 7*b* to radiate left channel sound waves substantially directionally in direction 18L faced by first transducer 72. First, second and fourth transducers 72, 74, 78 operate in a manner similar to transducers 101, 102, 107 of FIGS. 7*a* and 7*b* or transducers 108, 105, 104 of FIGS. 7*a* and 7*b* to radiate center channel sound waves substantially directionally in direction 20 faced by second transducer 74. Second, third and fourth transducers 74, 78, 76 operate in a manner similar to transducers 105, 104, 106 of FIGS. 7*a* and 7*b* to radiate left channel sound waves substantially directionally in direction 18R faced by fourth transducer 78. In the embodiment of FIGS. 8*a,* 8*b* and 8*c,* the first, second and fourth transducers 72, 74, 78 are used as primary transducers and as bucking transducers.

While the embodiments of FIGS. 2–8*c* primarily show the primary and the bucking transducers oriented approximately in space quadrature, the invention can be practiced with other relative orientations.

Figure 9A:
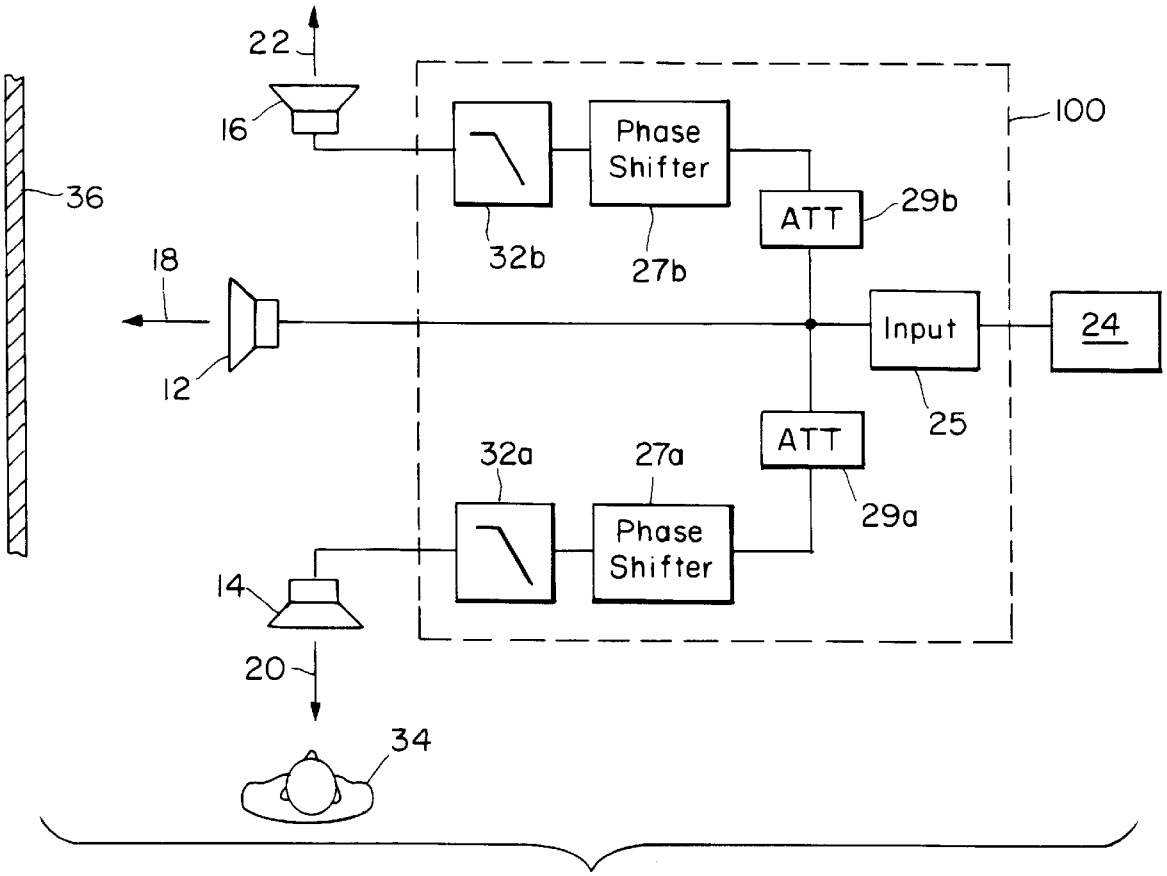
FIGS. 9*a*–9*d* are diagrammatic views of the loudspeaker system of FIG. 2, with the network shown in greater detail.

Referring now to FIG. 9*a,* there is shown a block diagram of loudspeaker unit 10 of FIGS. 1 and 2, with network 100 shown in more detail. Network 100 includes an input 25 coupled to first transducer 12. Input 25 is also coupled to second transducer 14 through a phase shifter 27*a,* an attenuator 29*a* and a low pass filter 32*a* and to third transducer 16 through a phase shifter 27*b,* an attenuator 29*b* and a low pass filter 32*b.*

In operation, an audio signal from audio signal source 24 enters audio signal input 25 and then first transducer 12. The audio signal from audio signal input 24 energizes second transducer 14 after attenuation and phase-shifting. The amount of attenuation and phase shift is such that when the sound wave radiated by the first transducer 12 reaches second transducer 14, the second transducer 14 radiates a sound wave that is of similar amplitude to, and out of phase with, the sound wave arriving from first transducer 12. Similarly, the audio signal on audio signal input 24 energizes third transducer 16 after attenuation and phase-shifting. The amount of attenuation and phase shift is such that when the sound wave radiated by first transducer 12 reaches third transducer 16, third transducer 16 radiates a sound wave that is of similar amplitude to, and out of phase with, the sound wave arriving from first transducer 12. As stated above, in the discussion of FIG. 2, when the out-of-phase sound waves radiated by the second transducer 14 and by third transducer 16 are of similar amplitude to the sound waves arriving from first transducer 12, there is substantial cancellation and significantly reduced sound transmission on the order of 10 dB or more in directions 20 and 22, respectively, thereby achieving the effect described above in the discussion of FIG. 2.

The amount of phase shift $\Delta\phi_1$ phase shifter 27*a* furnishes is typically $-180°-k_1f$, where f is the frequency, and $k_1$ is a constant determined by the length of the acoustic path $l_1$ (of FIG. 2) which separates first transducer 12 and second transducer 14. The amount of phase shift $\Delta\phi_2$ that phase shifter 27*b* furnishes is typically $-180°-k_2f$, where f is the frequency and $k_2$ is a constant determined by the length of the acoustic path $l_2$ (of FIG. 2) which separates first transducer 12 and third transducer 16. The amount of attenuation for second and third transducers 14 and 16 is sufficient to result in similar amplitudes for the sound waves arriving in their vicinity from first transducer 12.

The constant k is determined by the length of the acoustic path between the primary and the bucking transducers, or stated differently, by the time for sound waves radiated from the primary transducer to reach the vicinity of the bucking transducer. Generally, $$k = \frac{360l}{c}$$

where l is the length of the acoustic path between the bucking and primary transducers, and c is the speed of sound for the phase shift measured in degrees. As an example, in the implementation of FIG. 2, if the length of the acoustic path $l_1$ (of FIG. 2) between the primary transducer 12 and the bucking transducer 14 is 5 inches (approx. 0.4167 feet), and assuming a speed of sound of 1130 feet/sec., then $$k = \frac{(360)(0.4167)}{1130}$$

or 0.133, and phase shifter 27*a* shifts the phase by −180−0.133 f degrees. Thus, at a frequency of 500 Hz, the phase shift is −180−(0.133)(500) or −246.5°.

Figure 9B:
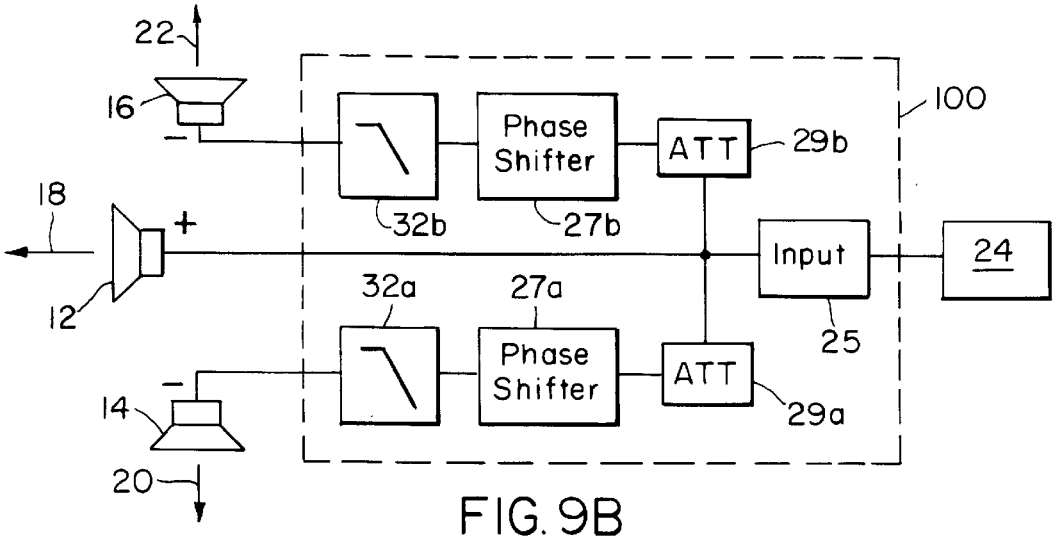

Referring now to FIG. 9*b,* there is shown an alternate embodiment of the loudspeaker system of FIG. 9*a.* Network 100 includes an input 25 coupled to first transducer 12. Input 25 is also coupled to second transducer 14 through phase shifter 27*a′,* an attenuator 29*a,* and a low pass filter 32*a* and to third transducer 16 through a phase shifter 27*b′,* an attenuator 29*b* and a low pass-filter 32*b.* The "+" at first transducer 12 and the "−" at second transducer 14 and third transducer 16 indicates that transducers 14 and 16 are driven in phase opposition to first transducer 12. This driving arrangement effectively accomplishes a −180° phase shift, so the amount of phase shift $\Delta\phi_1$ applied by phase shifter 27*a′* to achieve, in the vicinity of second transducer 14 an out-of-phase relationship between sound waves arriving from first transducer 12 and second transducer 14 is $-k_1f$, where $k_1$ is a constant determined by the length of the acoustic path which separates first transducer 12 and second transducer 14. Similarly, the amount of phase shift $\Delta\phi_2$ applied by phase shifter 27*b′* to achieve, in the vicinity of third transducer 16 an out-of-phase relationship between sound waves arriving from first transducer 12 and third transducer 16 is $-k_2f$, where $k_2$ is a constant determined by the length of the acoustic path which separates first transducer 12 and third transducer 16. The determination of constants k, $k_1$, and $k_2$ in this and the following embodiments is as described above in the discussion of FIG. 9*a.* In the example of a distance l of 0.4167 feet between the first (primary) transducer 12 and a second (bucking) transducer 14, and the value of $k_1$ is 0.133, and the phase shifter 27*a′* shifts the phase by an amount $\Delta\phi_1$ which is equal to −0.133 f or, for example −66.5° at a frequency of 500 Hz. The required −244.5° (as taught in the discussion of FIG. 9*a*) is accomplished by a −180° phase shift resulting from the reversed polarity connection and a −66.5° caused by phase shifters 27*a*' and 27*b′.*

Figure 9C:
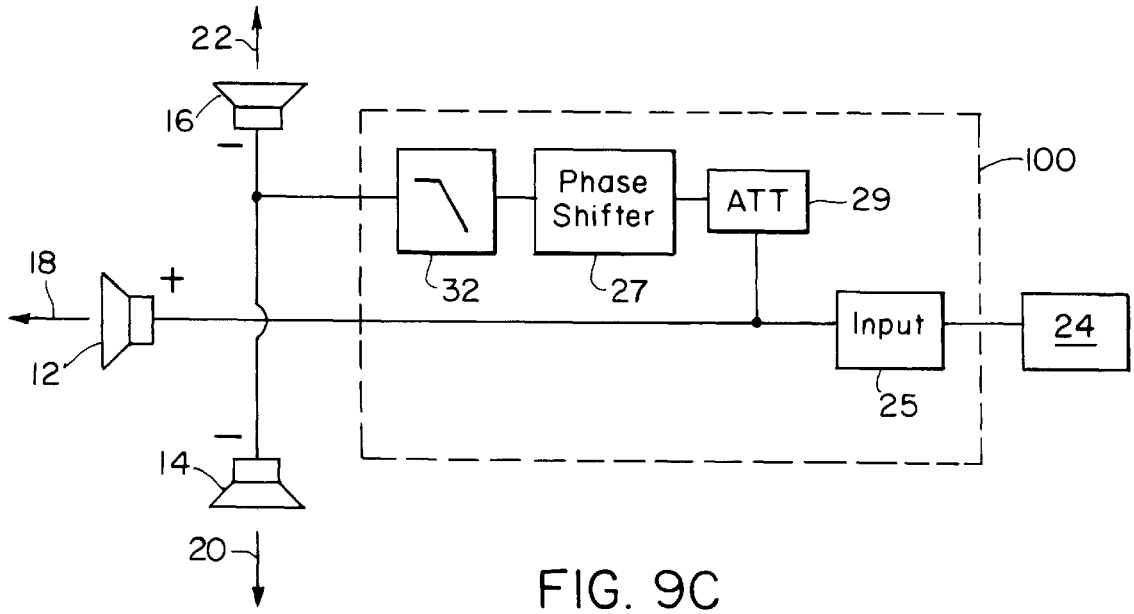

Referring now to FIG. 9*c,* there is shown another alternate embodiment of the loudspeaker system of FIG. 9*a.* In the loudspeaker system of FIG. 9*c,* the "+" at first transducer 12 and the "−" at second transducer 14 and third transducer 16 indicate the same relationship as stated above in the discussion of FIG. 9*b.* Network 100 of FIG. 9*c* includes an input 25 coupled to first transducer 12 and coupled to second and third transducers 14 and 16 through a common phase shifter 27, attenuator 29 and low pass filter 32. In this embodiment, the length of the acoustic path between first transducer 12 and second transducer 14 and the length of the acoustic path between first transducer 12 and third transducer 16 are approximately the same. The amount of phase shift $\Delta\phi$ caused by phase shifter 27 is −kf, where k is a constant determined in the same manner as the constants $k_1$ and $k_2$ of FIG. 9*b*. The embodiment of FIG. 9*c* could be implemented with the phase shifter of FIG. 9*a* and appropriate connections for second and third transducers 14, 16.

Figure 9D:
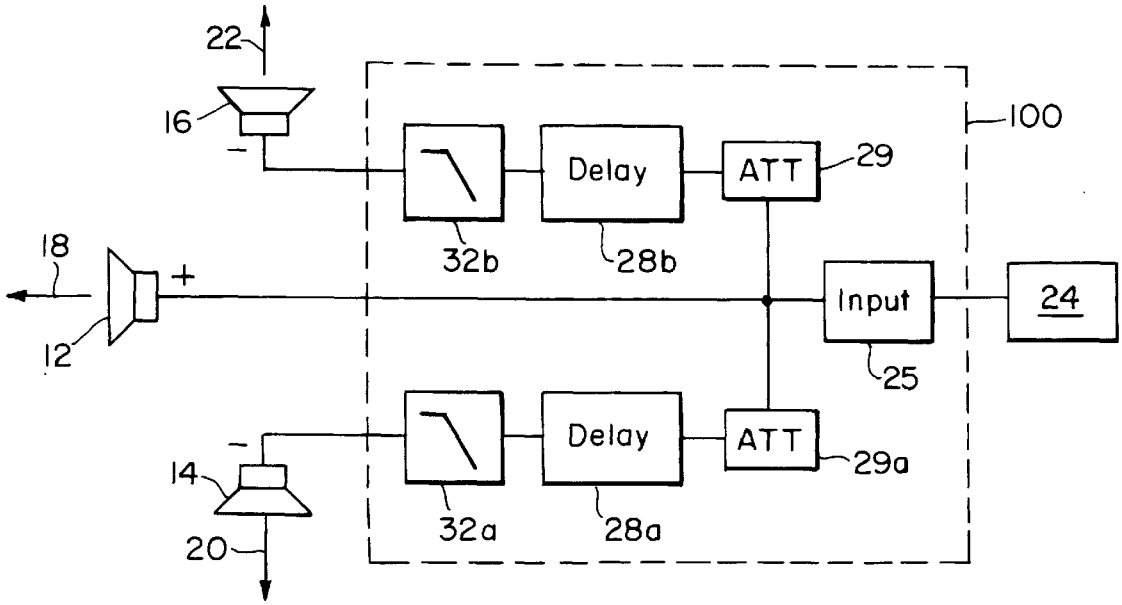

Referring now to FIG. 9*d*, there is shown another alternate embodiment of the loudspeaker system of FIG. 9*a*. Audio signal input 25 is coupled to first transducer 12. Input 25 is also coupled to second transducer 14 through a delay network 28*a*, an attenuator 29*a*, and a low pass filter 32*a* and coupled to third transducer 16 through a delay network 28*b*, an attenuator 29*b* and a low pass filter 32*b*. In the loudspeaker system of FIG. 9*d*, the "+" at first transducer 12 and the "−" at second transducer 14 and third transducer 16 indicate the same relationship as stated above, in the discussion of FIG. 9*b*. The amount of time delay Δt caused by delay network 28*a* is the amount of time it takes a sound wave radiated by first transducer 12 to reach second transducer 14, or $l_1/c$, where $l_1$ is the length of the acoustic path between first transducer 12 and second transducer 14 and c is the speed of sound. So, for example if the distance $l_1$ is 0.4167 feet, and the speed of sound is 1130 feet per second, the delay Δt=0.4167/1130 or 369 μseconds. The embodiment of FIG. 9*d* could be implemented with a common attenuator, delay, and low pass filter, in the manner of FIG. 9*c*.

Figure 10A:
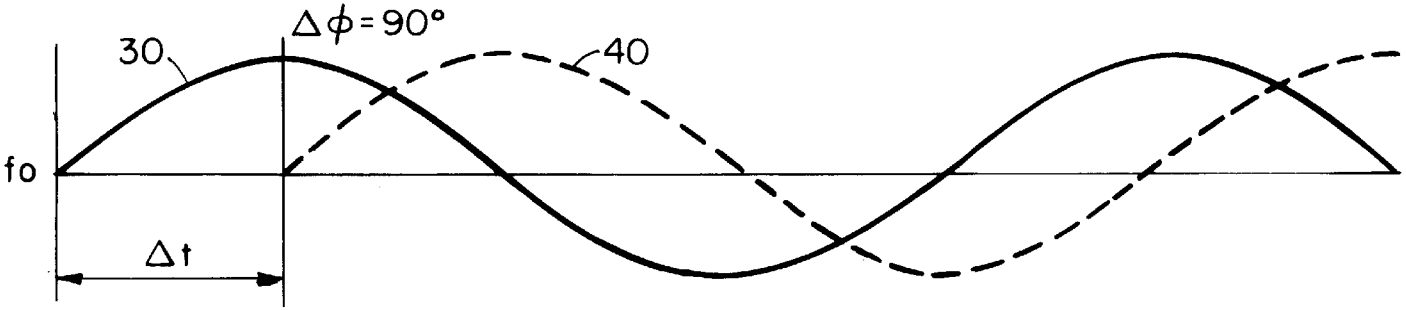
FIG. 10 is a graphical representation of relative phase vs. time delay of a network such as those of FIGS. 9*a*–9*d;*
Figure 10B:
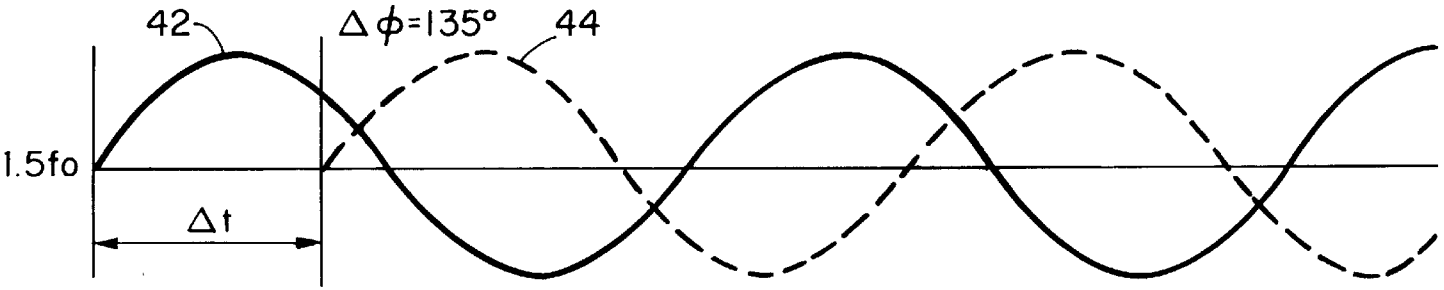
Figure 10C:
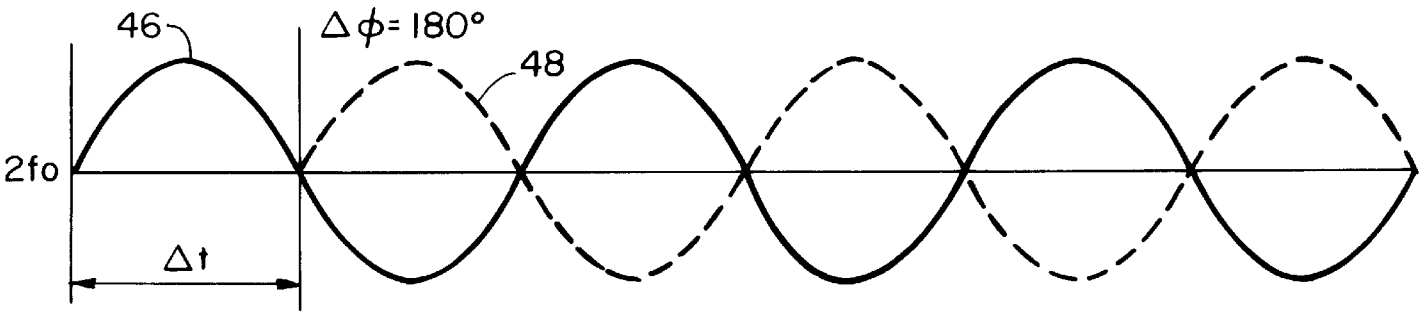

Referring to FIG. 10, there is shown a graphical representation of signal waveforms, at different frequencies, helpful in explaining the relationship between the phase shifters of FIG. 9*a*–9*c* and the delay network of FIG. 9*d*. At frequency $f_O$ (waveform 38) a time delay of interval Δt is equivalent to a phase shift Δϕ of 90° (waveform 40). At frequency 1.5 $f_O$ (waveform 42) a time delay of interval Δt is equivalent to a phase shift Δϕ of 135° (waveform 44), or 1.5 times the phase shift indicated by waveform 40. At frequency 2 $f_O$ (waveform 46) a time delay of interval Δt is equivalent to a phase shift Δϕ of 180° (waveform 48) or two times the phase shift Δϕ indicated by waveform 40. Similarly, it can be shown that at other frequencies, a time delay of interval Δt is equivalent to a phase shift Δϕ that is proportional to frequency.

Figure 11A:
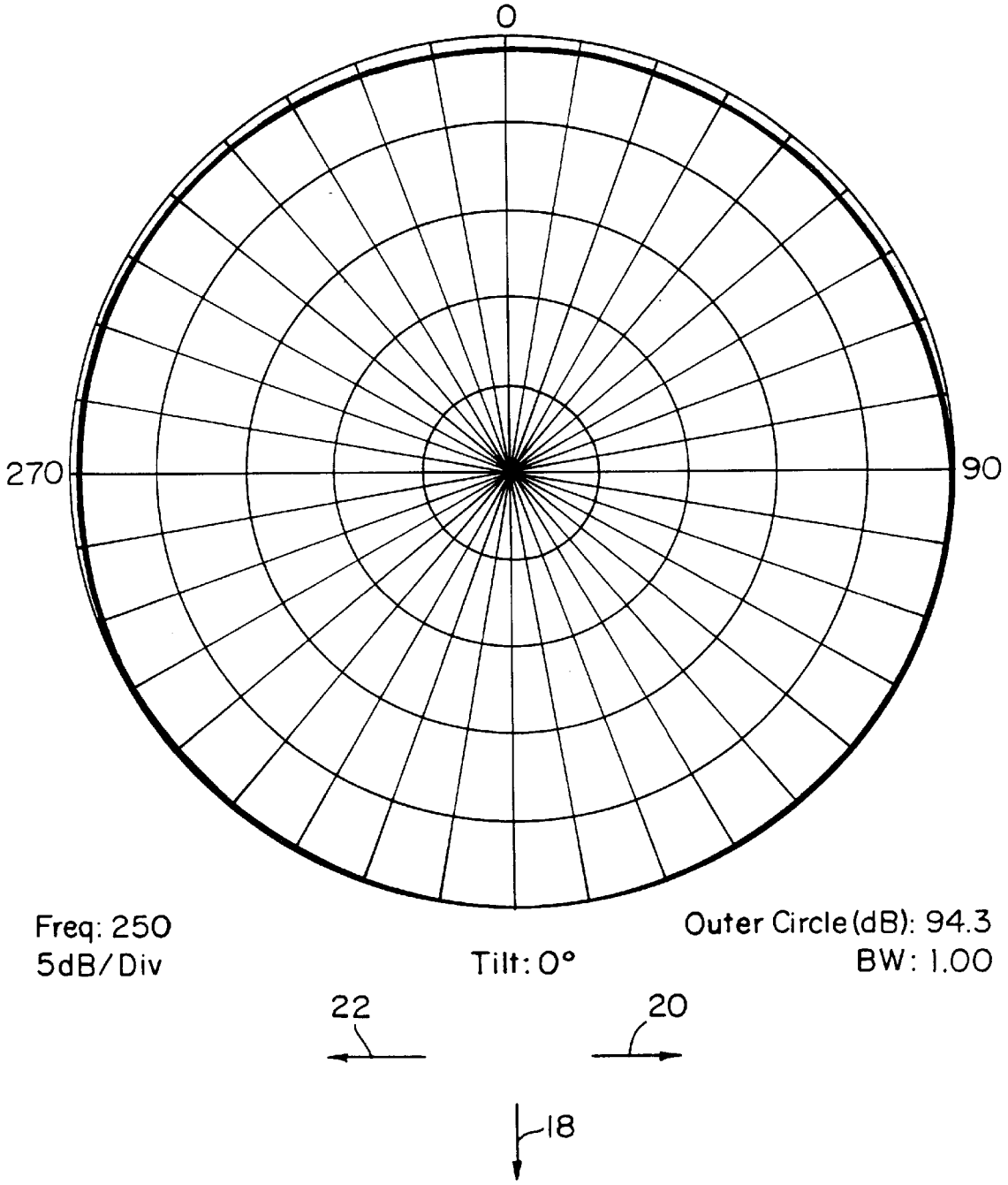
FIGS. 11*a*–11*d* are polar plots of the sound field of transducers such as those used in an embodiment of the invention.
Figure 11B:
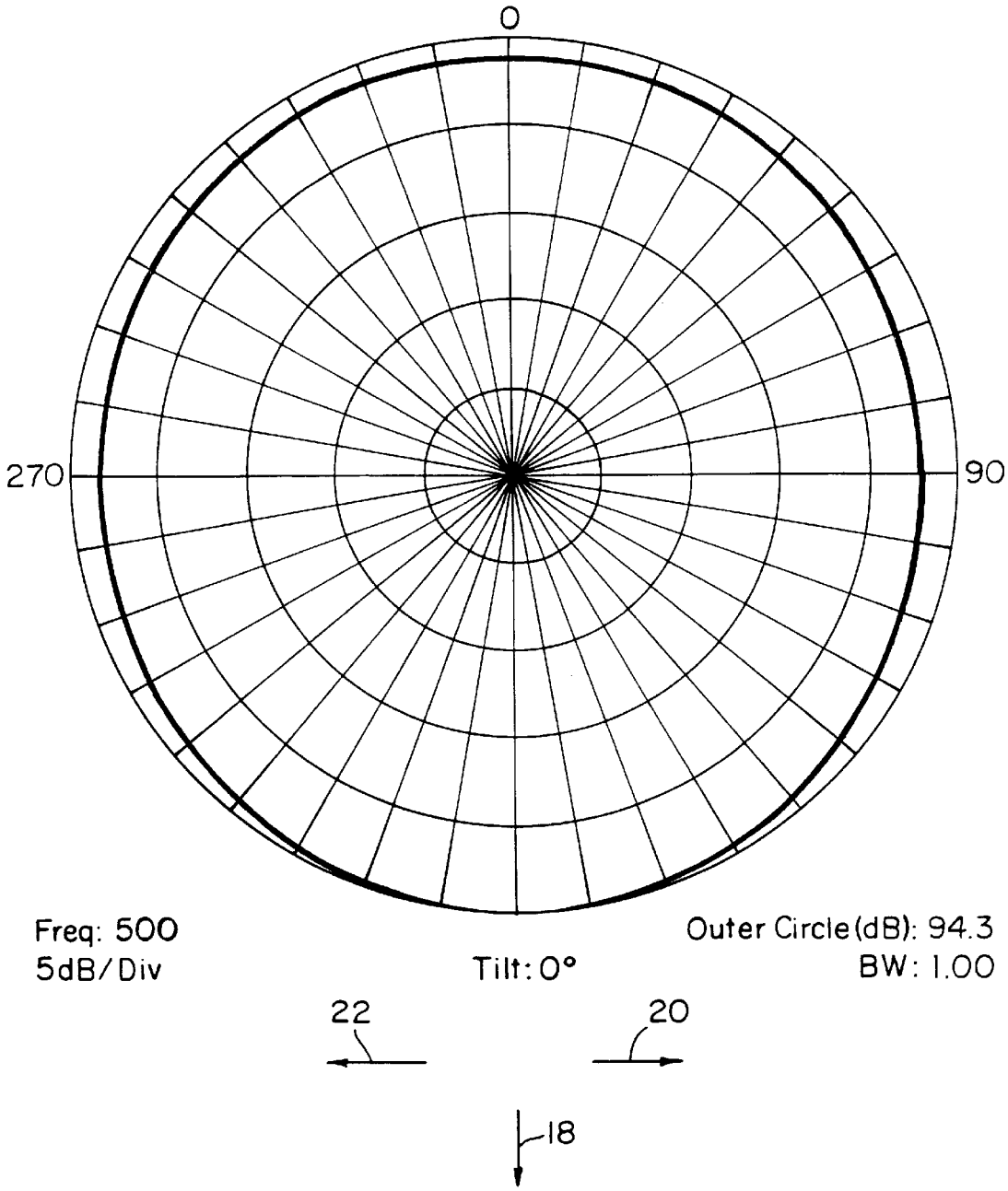
Figure 11C:
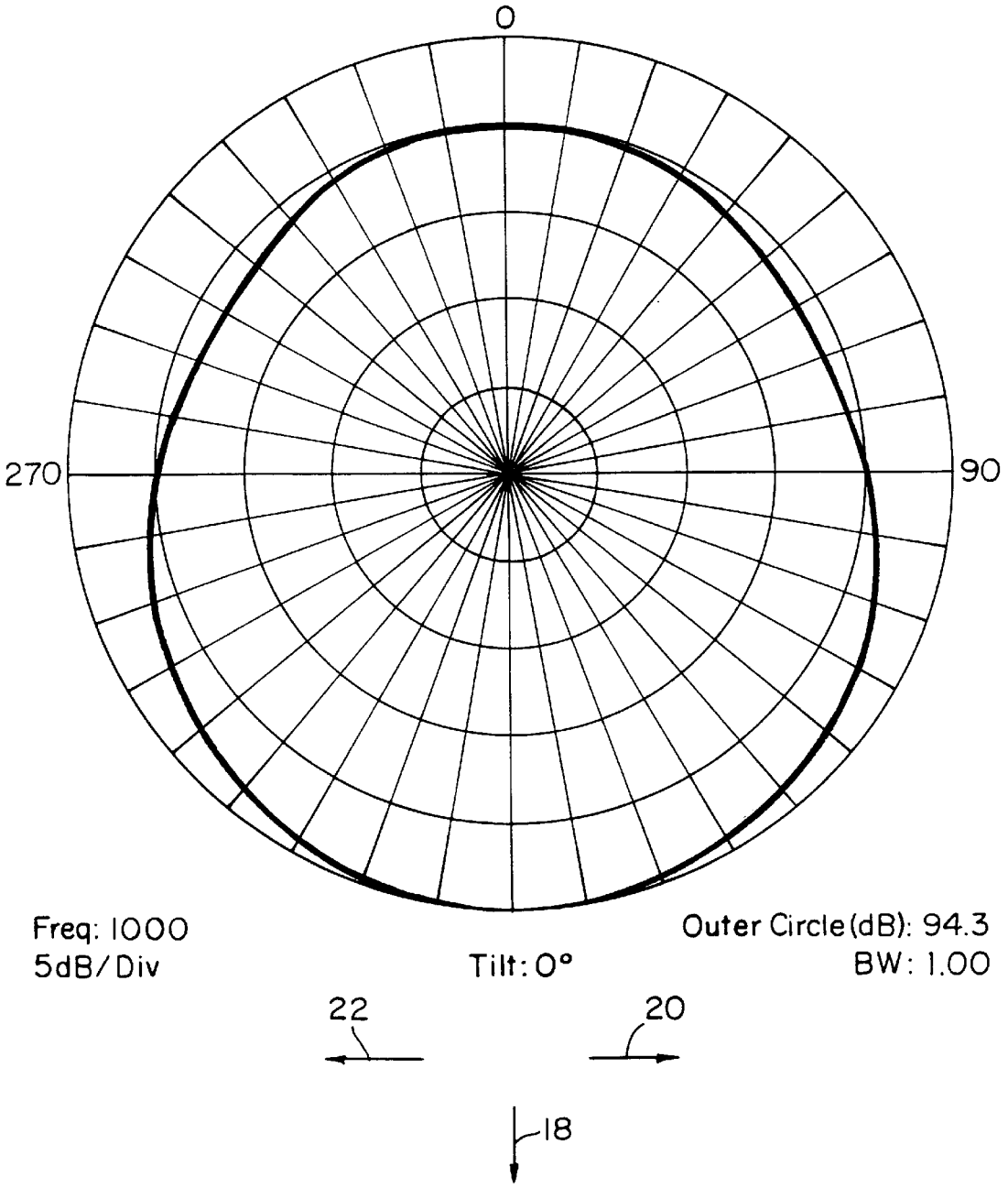
Figure 11D:
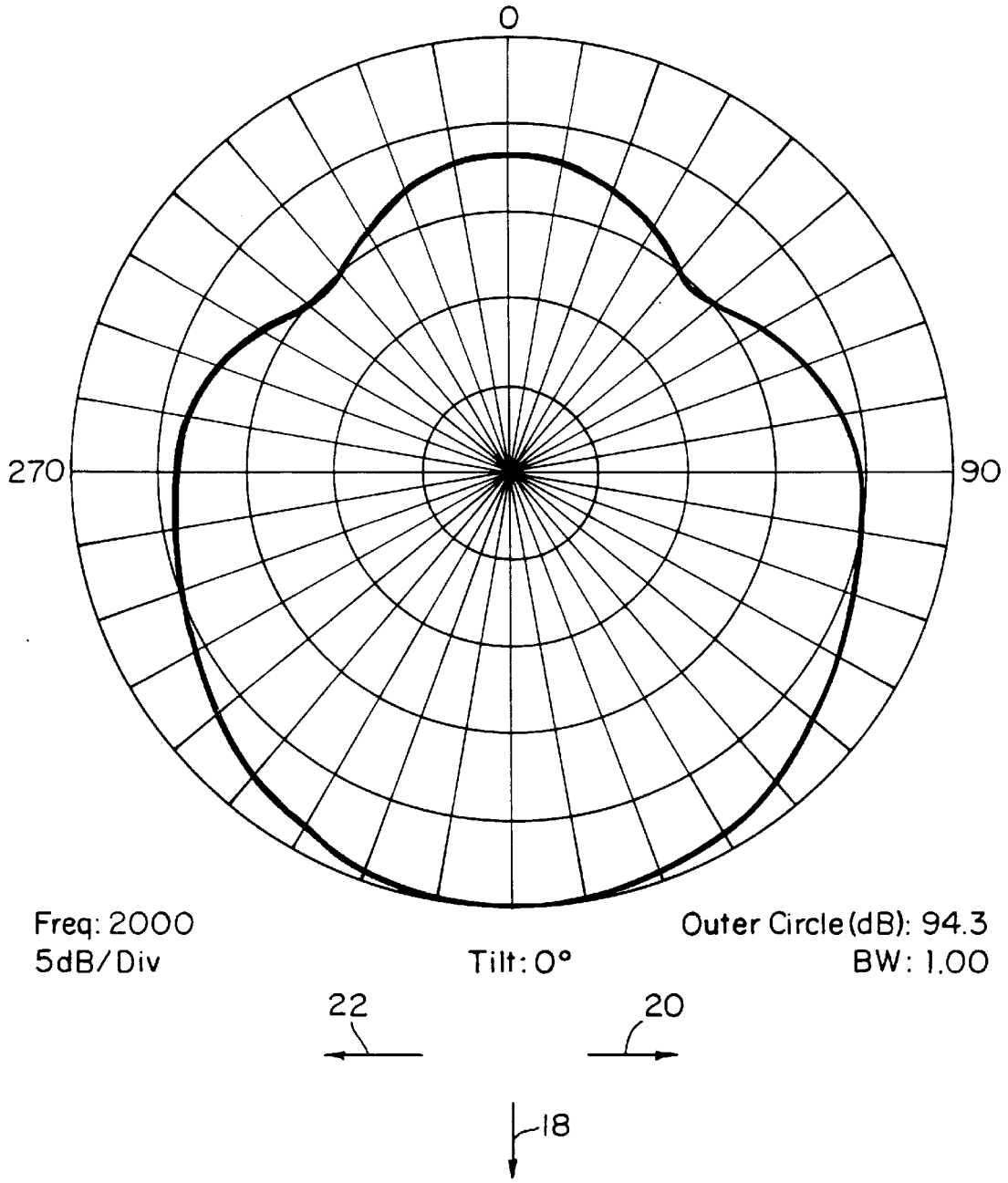

Referring to FIGS. 11*a*–11*d*, there are shown exemplary polar patterns of the sound field produced by an exemplary full range transducer at frequencies of 250 Hz, 500 Hz, 1000 Hz and 2000 Hz, respectively. The patterns of FIGS. 11*a*–11*c* are helpful in explaining low pass filter 32*b* of FIGS. 9*a*, 9*b* and 9*d* and low pass filter 32 of FIG. 9*c*. FIG. 11*a* approximates the sound field polar pattern in the octave of frequencies approximately 177 Hz to 354 Hz (hereinafter referred to as the 250 Hz octave). The first transducer is effectively essentially omnidirectional in this frequency range; that is, the sound radiated at any direction from the transducer is substantially equal in amplitude to that radiated along the transducer axis in direction 18. FIG. 11*b* shows the polar pattern in the octave of frequencies approximately 354 Hz to 707 Hz (hereinafter referred to as the 500 Hz octave). The sound field polar pattern is generally omnidirectional, but slightly more directional than in the frequency range shown in FIG. 11*a*. In the direction indicated by arrows 20 and 22 and in the direction opposite the direction of arrow 18, the field is approximately 1 db weaker. FIG. 11*c* shows the sound field polar pattern in the octave of frequencies approximately 707 Hz to 1414 Hz (hereinafter referred to as the 1 Khz octave). In this frequency range first transducer 12 is somewhat directional. In the direction indicated by arrows 20 and 22 and in the direction opposite the direction of arrow 18, the field is approximately 5 dB weaker. FIG. 11*d* shows the sound field in the octave of frequencies approximately 1.4 Khz to 2.8 Khz (hereinafter referred to as the 2 Khz octave). In this frequency range, first transducer 12 is sore strongly directional. In the direction indicated by arrows 20 and 22 and in the direction opposite the direction of arrow 18, the field is more than 5 dB weaker.

Referring again to FIG. 2, above a certain frequency (in the above described embodiments approximately 1 Khz), transducers 12, 14 16 radiate sound waves which are substantially directional along the axis of the transducer (in this case, direction 18). As a result, the sound energy from a group of transducers whose axes are arranged generally orthogonally does not interact at higher frequencies to the extent that it does at lower frequencies. As a result, sound waves above this certain frequency radiated by second transducer 14 directly at a listener 34, or radiated by third transducer 16 and reflected off the rear reflecting surface 37 to listener 34 may become louder relative to (as well as arriving earlier than) the sound radiated in direction 18 and reflected to the listener. Listener 34 may therefore localize on second transducer 14.

A feature of the invention is to operate the bucking transducers over a narrower range of frequencies from the primary transducer range, typically the range of frequencies at which the primary transducer radiates sound waves substantially omnidirectionally. Low pass filters 32*a* and 32*b* (of FIGS. 9*a*, 9*b* and 9*d*) or low pass filter 32 (of FIG. 9*c*) embody one approach for achieving this feature by significantly attenuating spectral components of the audio signal above a predetermined cutoff frequency.

The range of frequencies at which a transducer radiates sound essentially omnidirectionally is typically related to the dimensions of the radiating surface of the transducer. At frequencies at which the wavelength of the sound waves approaches the dimensions of the radiating surface of a transducer, the transducer begins to radiate sound more directionally. For example, with 2¼ inch diameter transducers used in exemplary embodiments described above, at a frequency of 1 Khz (wavelength about 13 inches, approximately twice the circumference of the transducer) the transducer radiates sound essentially directionally. Therefore a low pass filter with a cutoff frequency of about 1 Khz is used to cause the bucking transducers to operate in a range of frequencies up to about 1 Khz, while the primary transducers operate to much higher frequencies.

A variety of different sound fields could be generated by varying the parameters of delay network 28, phase shifter 27, attenuator 29, or equalizer 26, by varying the frequency response of low pass filter 32, or by using different transducers.

Figure 12:
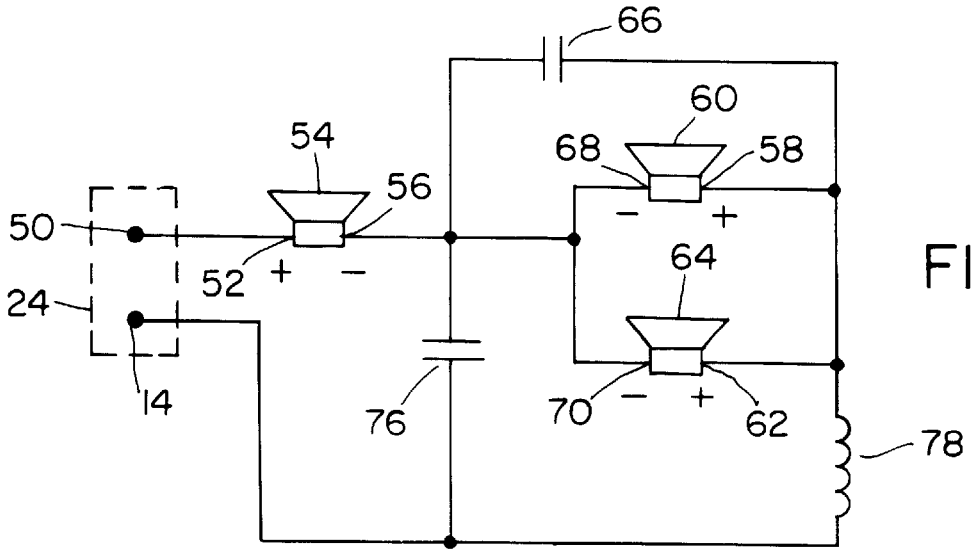
FIG. 12 is a schematic diagram of a circuit for implementing the network portion of an embodiment of the invention.

Referring to FIG. 12, there is shown a circuit for implementing phase shifter 27, attenuator 29, and low pass filter 32 of network 100 of FIG. 9*c*. A first terminal 50 of audio signal input 24 is connected to positive terminal 52 of a first transducer 54. The negative terminal 56 of first transducer 54 is coupled to a first terminal of bipolar capacitors 66 and 76 and is further coupled to the negative terminals 68, 70 of the second and third transducers 60, 64 respectively. A second terminal 74 of audio signal input 24 is coupled to a second terminal of bipolar capacitor 76 and is further coupled to a first terminal of inductor 78. The positive terminals of transducers 60, 64 are coupled to a second terminal of bipolar capacitor 66 and to a second terminal of inductor 78. First transducer 54 corresponds to first transducer 12 of FIG. 9*c*. The second and third transducers 60, 64 correspond to the second and third transducers 14, 16 of FIG. 9*c*.

In one embodiment of the invention, transducers 54, 60, 64 are 2¼" full range electroacoustical transducers, with the radiating surfaces separated by a distance of approximately five inches. With a first capacitor 66 of 47 μF, a second capacitor 76 of 94 μF, an inductor 78 of 0.5 mh, the network results in the relative amplitude and phase response of transducers 60, 64 to transducer 54 shown below in FIGS. 13*a*–13*c*.

Figure 13A:
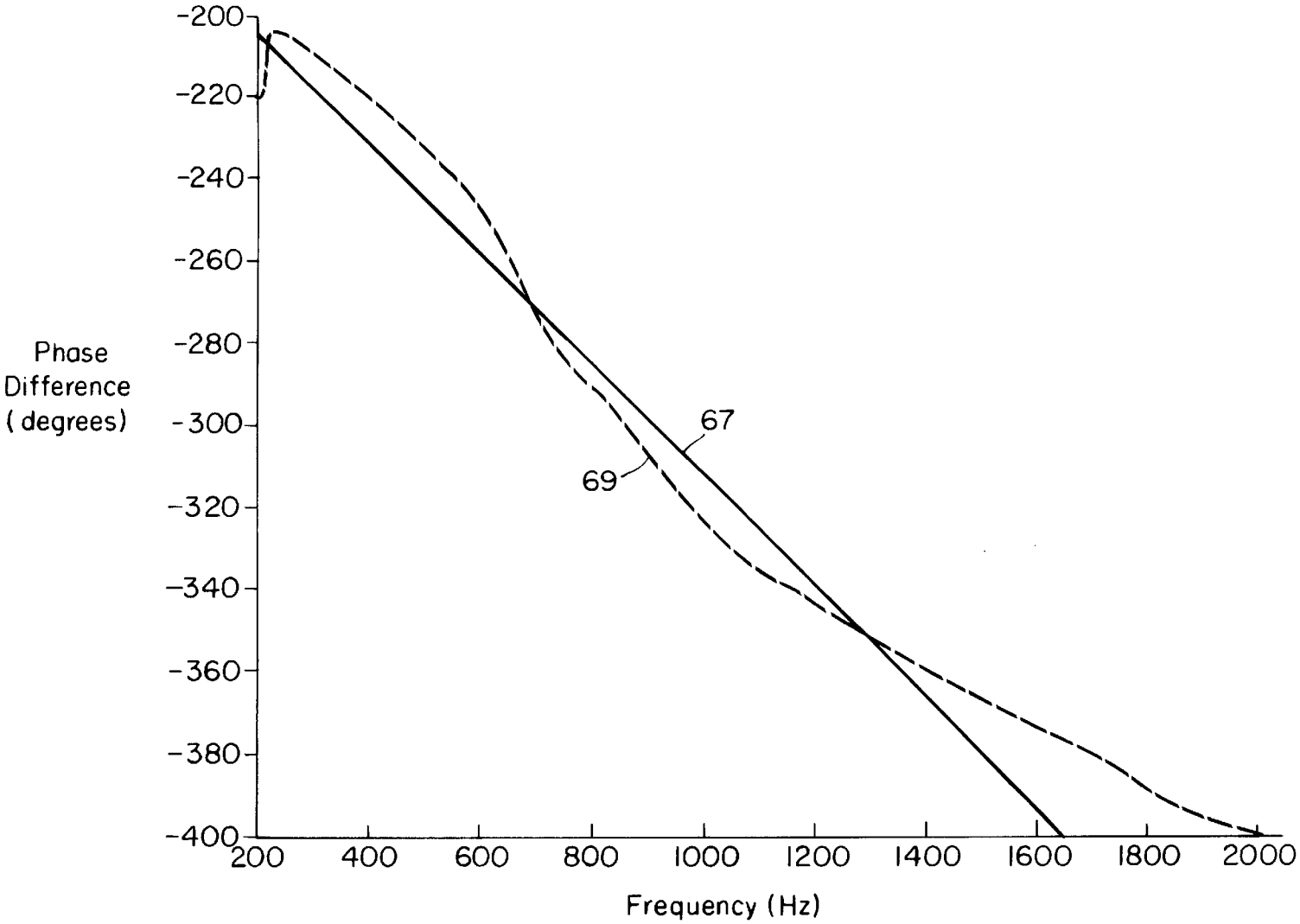
FIGS. 13*a*–13*c* are graphical representations of phase difference, delay and amplitude, respectively, as a function of frequency for the circuit of FIG. 12.

Referring to FIG. 13*a*, there is shown a phase difference between the audio signal input to second, third transducers 60, 64 (which are equivalent to graphical representation of bucking transducers 14, 16 of FIG. 9*c*) and the audio signal input to first transducer 54 as a function of frequency. Curve 67 represents a theoretical ideal relationship between the phase difference and the frequency for an acoustical path of approximately 5 inches (0.4167 feet), according to the equation $\Delta\phi=-180°-kf$ where k=0.133 and f is the frequency. Since the phase difference is proportional to the frequency, curve 67 has a constant slope. Curve 69 represents an actual phase difference provided by the circuit of FIG. 12.

Figure 13B:
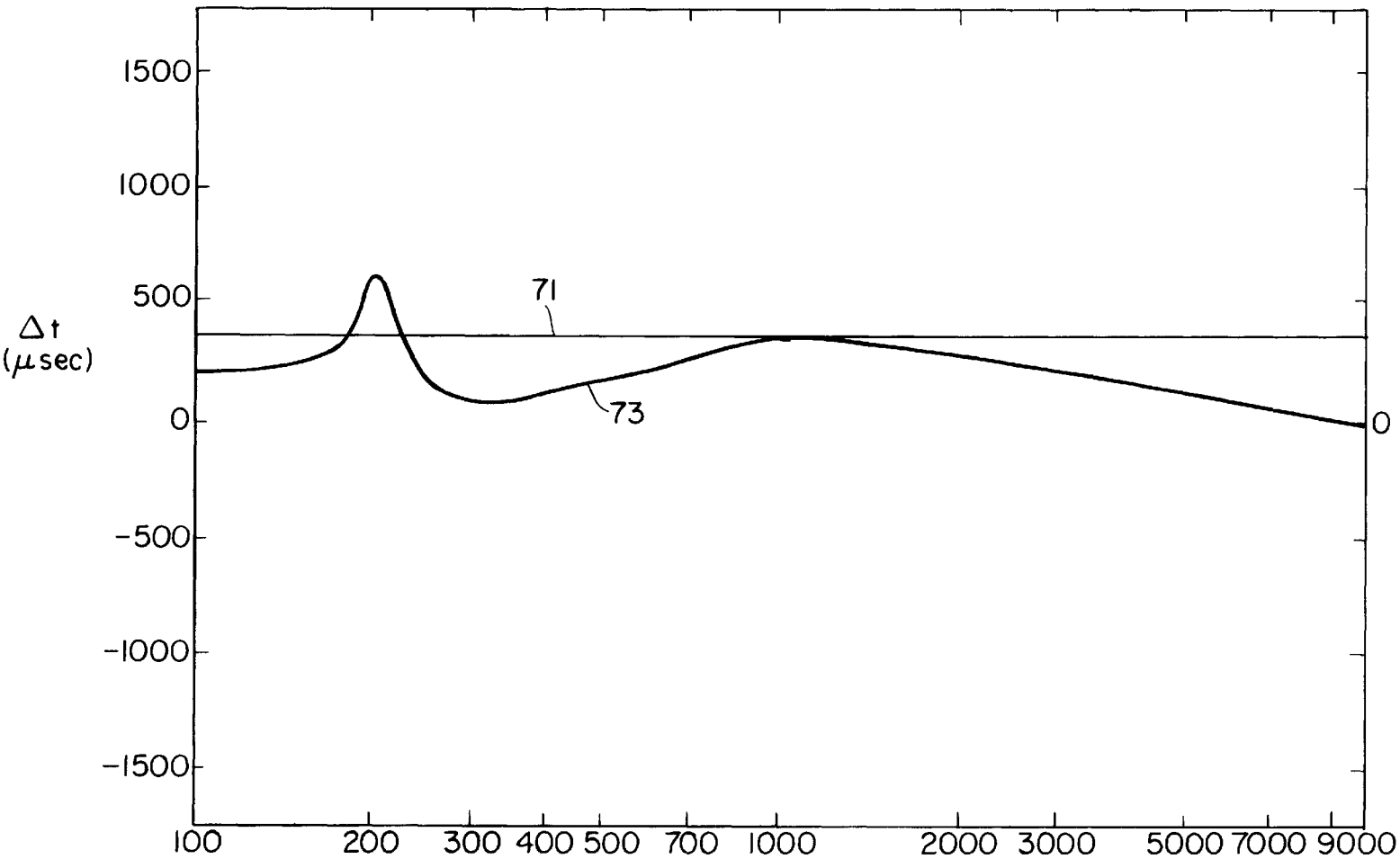

Referring to FIG. 13*b*, there is shown a graphical representation of time difference curve 73 between the audio signal input to second, third transducers 60, 64 (which are equivalent to bucking transducers 14, 16 of FIG. 9*c*) and the audio signal input to the first transducer 54 (which is equivalent to the primary transducer 12 of FIG. 9*c*) as a function of frequency for the circuit of FIG. 12. Curve 71 represents length of time it takes sound to travel five inches (0.4167 feet) if the speed of sound is 1130 feet per second.

Figure 13C:
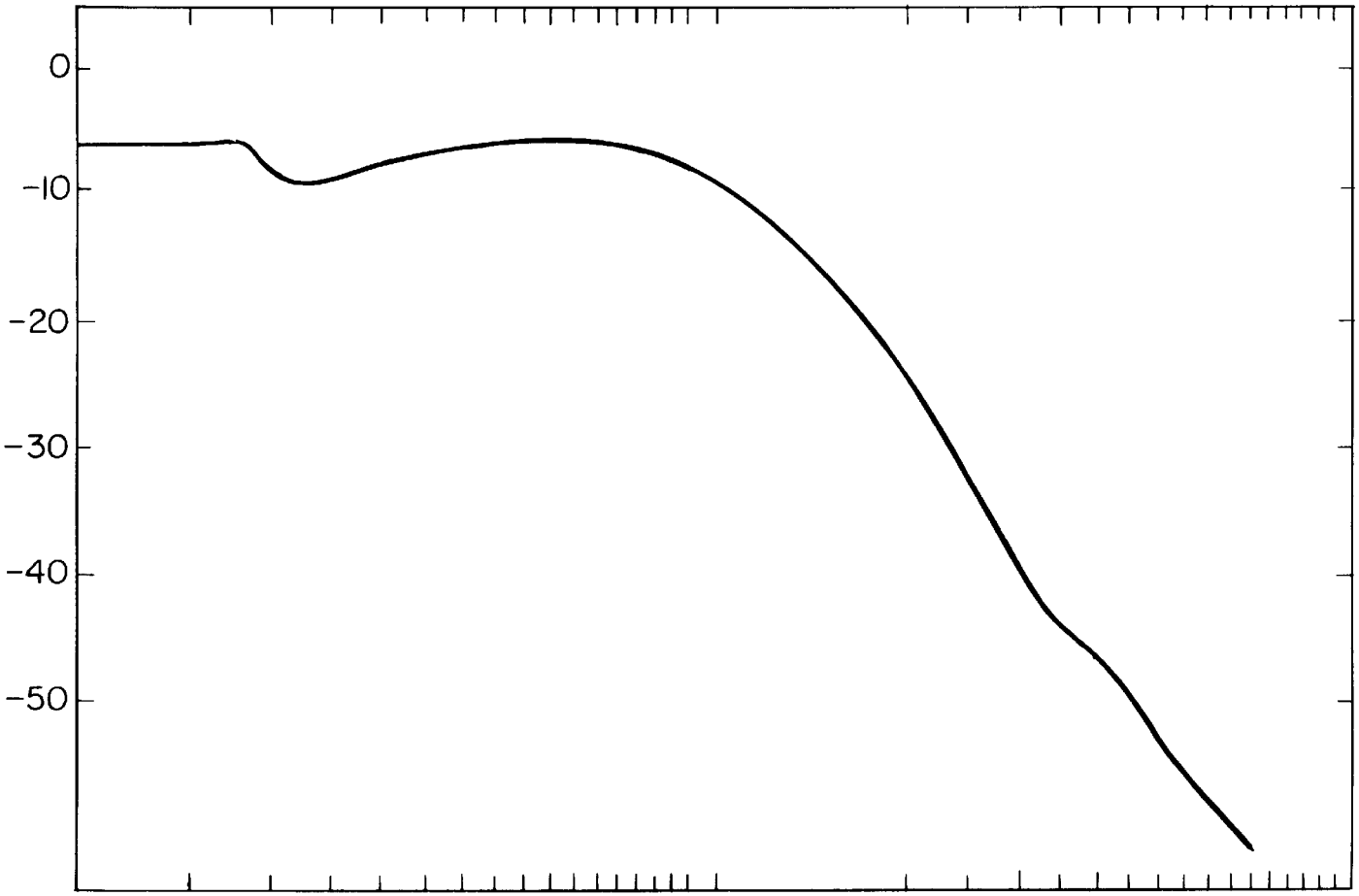
Figure 14A:
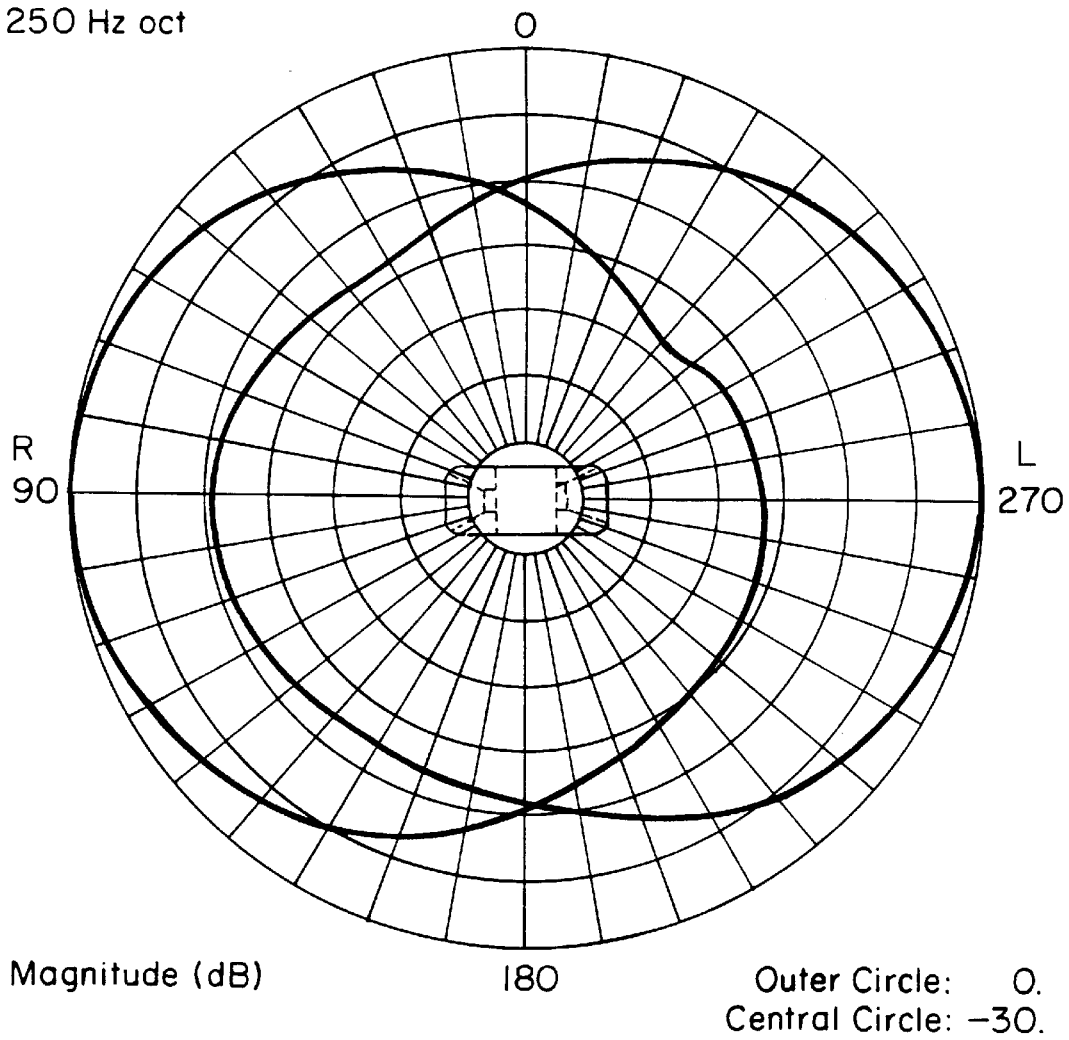
FIGS. 14*a*–14*f* are polar plots of the sound field of an embodiment of the invention.
Figure 14B:
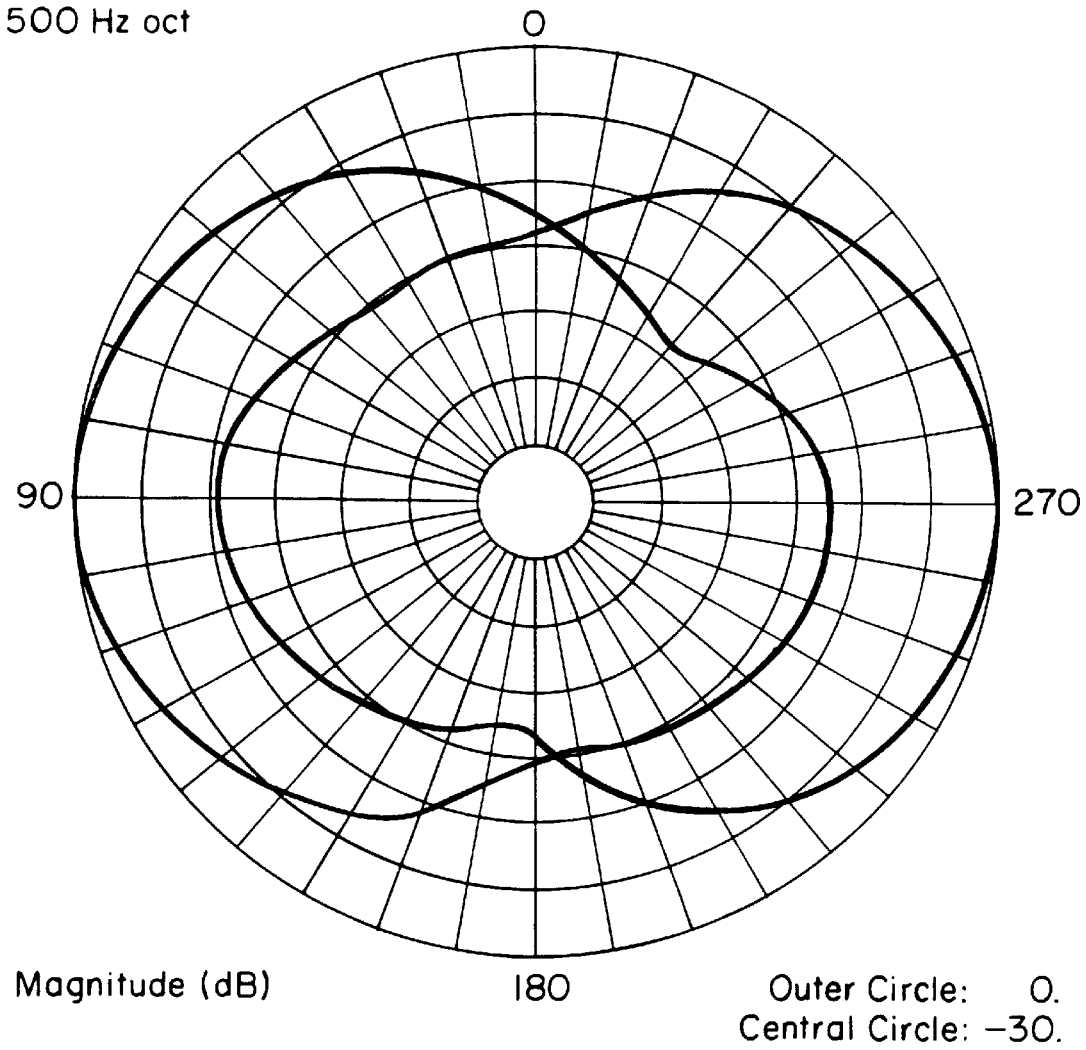
Figure 14C:
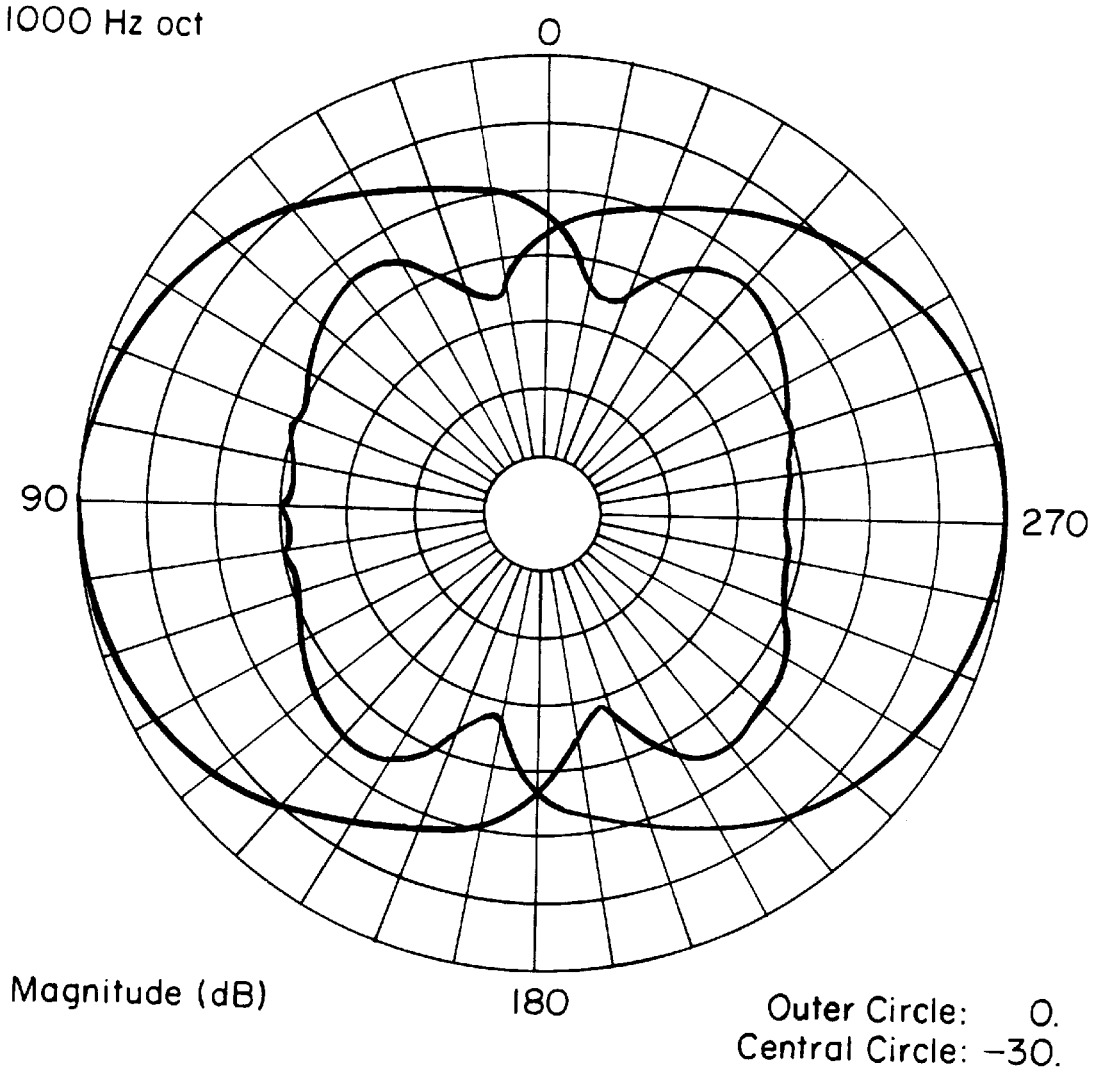
Figure 14D:
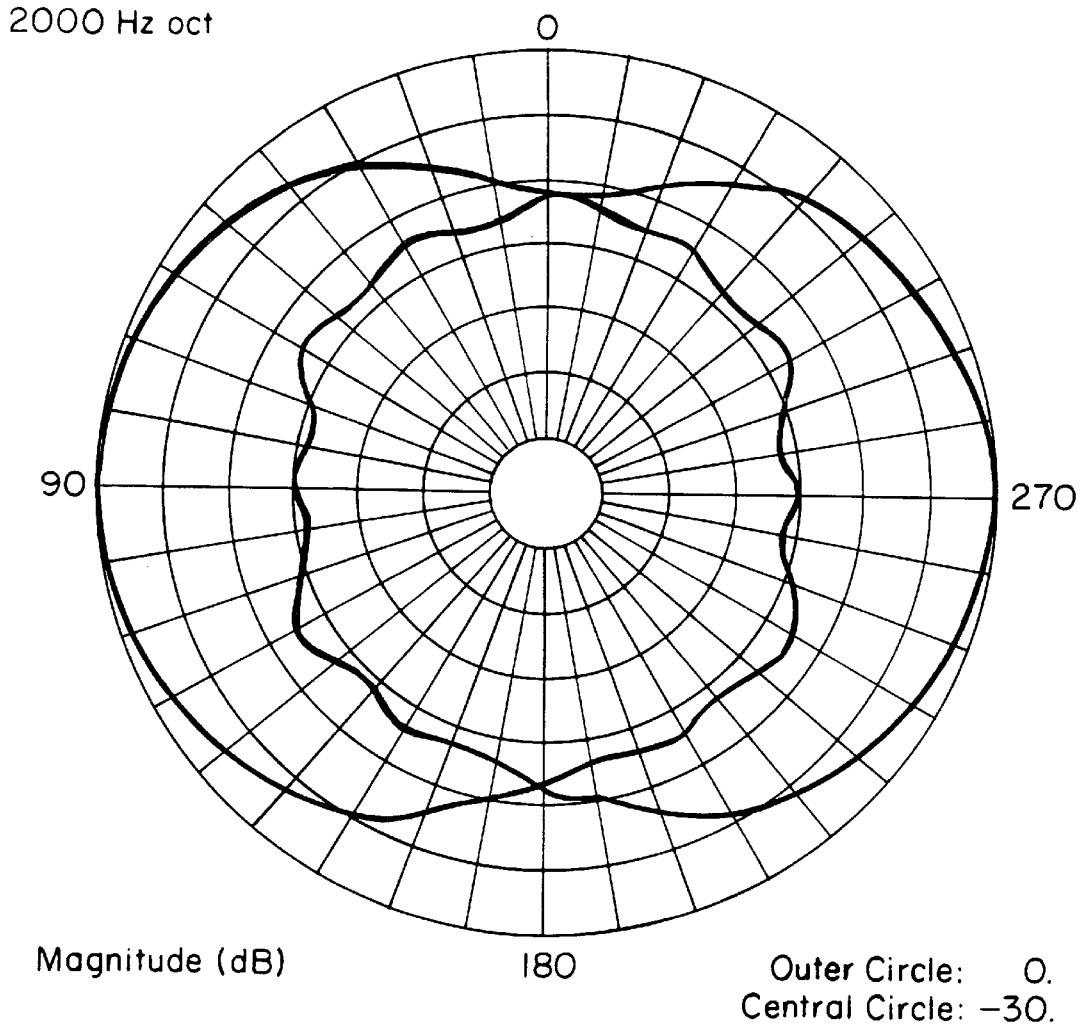
Figure 14E:
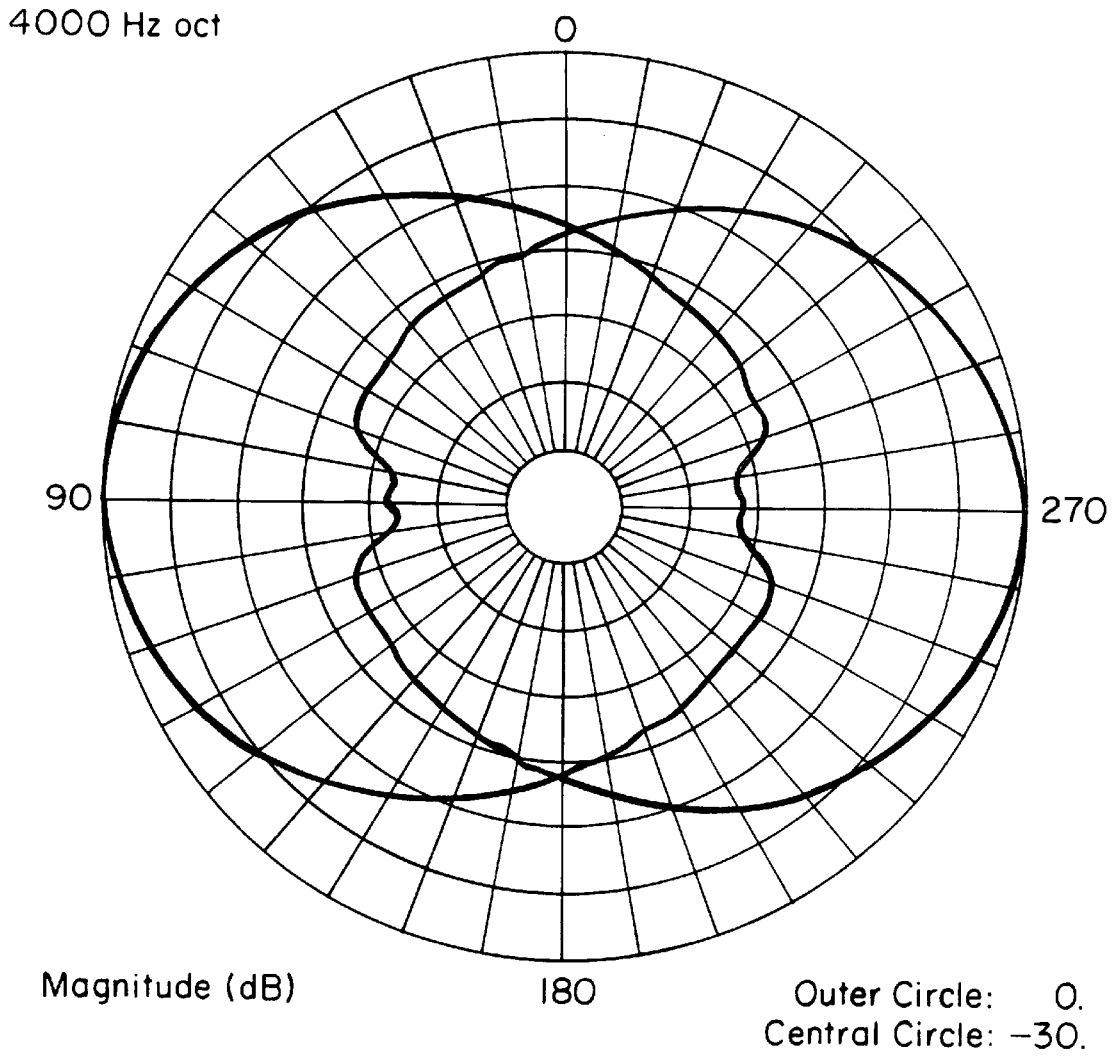
Figure 14F:
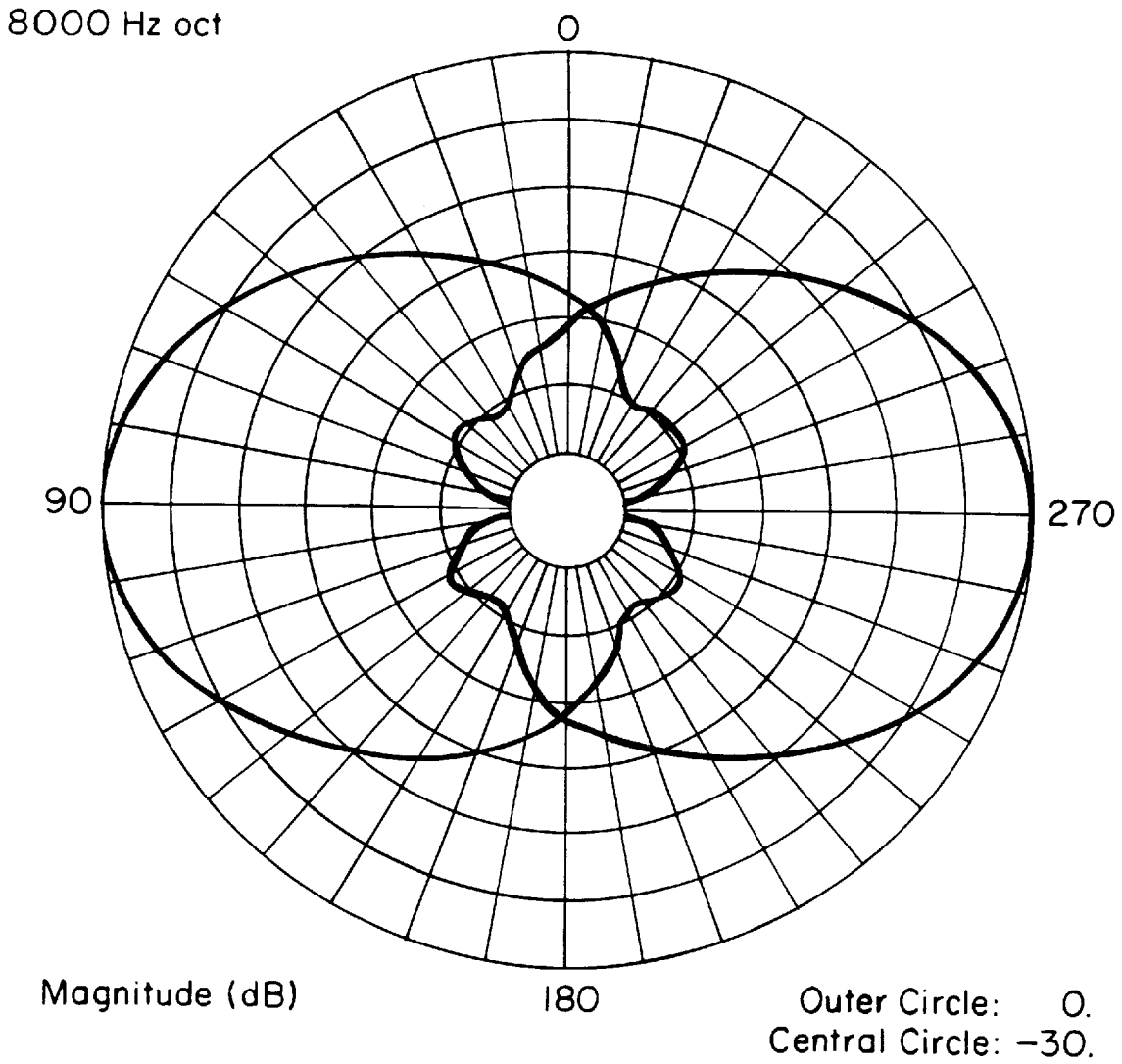

Referring to FIG. 13*c*, there is shown the ratio of the voltage across the terminals of second, third transducers 60, 64 (which are equivalent to bucking transducers 14, 16 of FIG. 9*c*) to the voltage across the terminals of first transducer 54 (which is equivalent to the primary transducer 12 of FIG. 9*c*) as a function of frequency. The circuit of FIG. 12 acts as a low pass filter, with a break frequency of about 1 Khz. The low pass filter significantly reduces the sound directly radiated by the second and third transducers in the frequency region where they are directional along their axes so that listener 34 localizes on the sound waves radiated by first transducer 12 and reflected off the acoustically reflecting surface 36.

Referring to FIGS. 14*a*–14*f*, there are shown the sound field polar pattern measurements (in the plane of the axes of transducers 12, 14, 16) averaged over a one octave frequency range, resulting from a system of the embodiment of FIG. 4 as implemented in FIG. 12. In each of FIGS. 14*a*–14*f*, the directions indicated by arrows 18L, 18R, 20, and 22, correspond to the similarly numbered directions in FIG. 4. Curves 130 and 131 are the magnitude of the sound, in dB radiated by loudspeaker units 10L and 10R, respectively, of FIG. 4. Each of the concentric circles of the graph represents a difference of −5 dB. For each of the octave bands, the difference between the amplitude of the sound in directions 18L and 18R and the amplitude of the sound in directions 20 and 22, respectively, is equal to or greater than −10 dB.

Figure 15A:
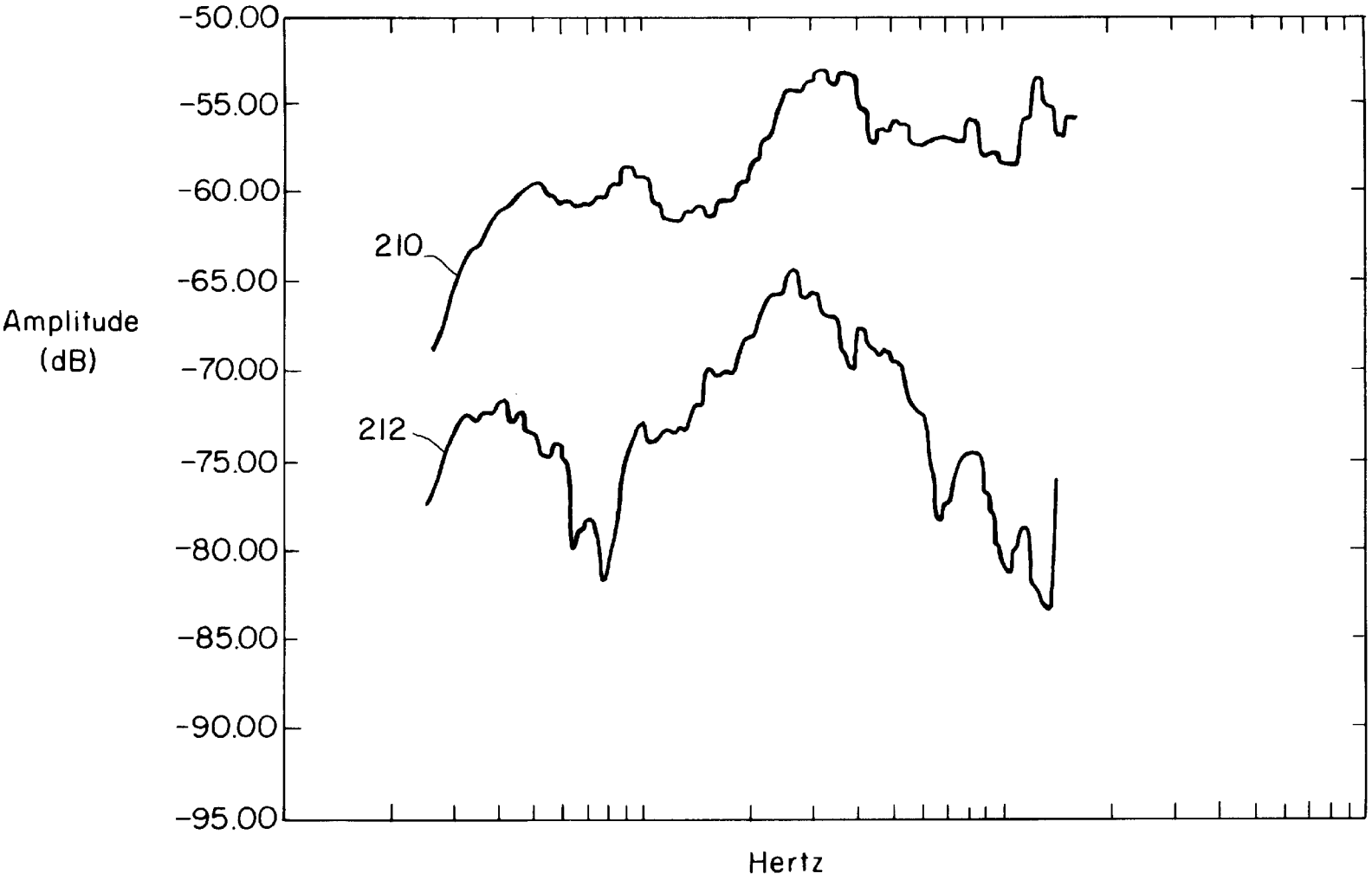
FIGS. 15*a* and 15*b* are graphical representations of sound intensity as a function of frequency radiated in two different directions by a loudspeaker system according to the invention.

Referring to FIG. 15*a*, there is shown a graph of the measurement of the amplitude in dB of the sound radiated by loudspeaker unit 10L of FIG. 4, in directions 18L and 20 as a function of frequency. Curve 210 represents the amplitude of sound field radiated in direction 18L, while curve 212 represents the amplitude of the sound field radiated in direction 20.

Figure 15B:
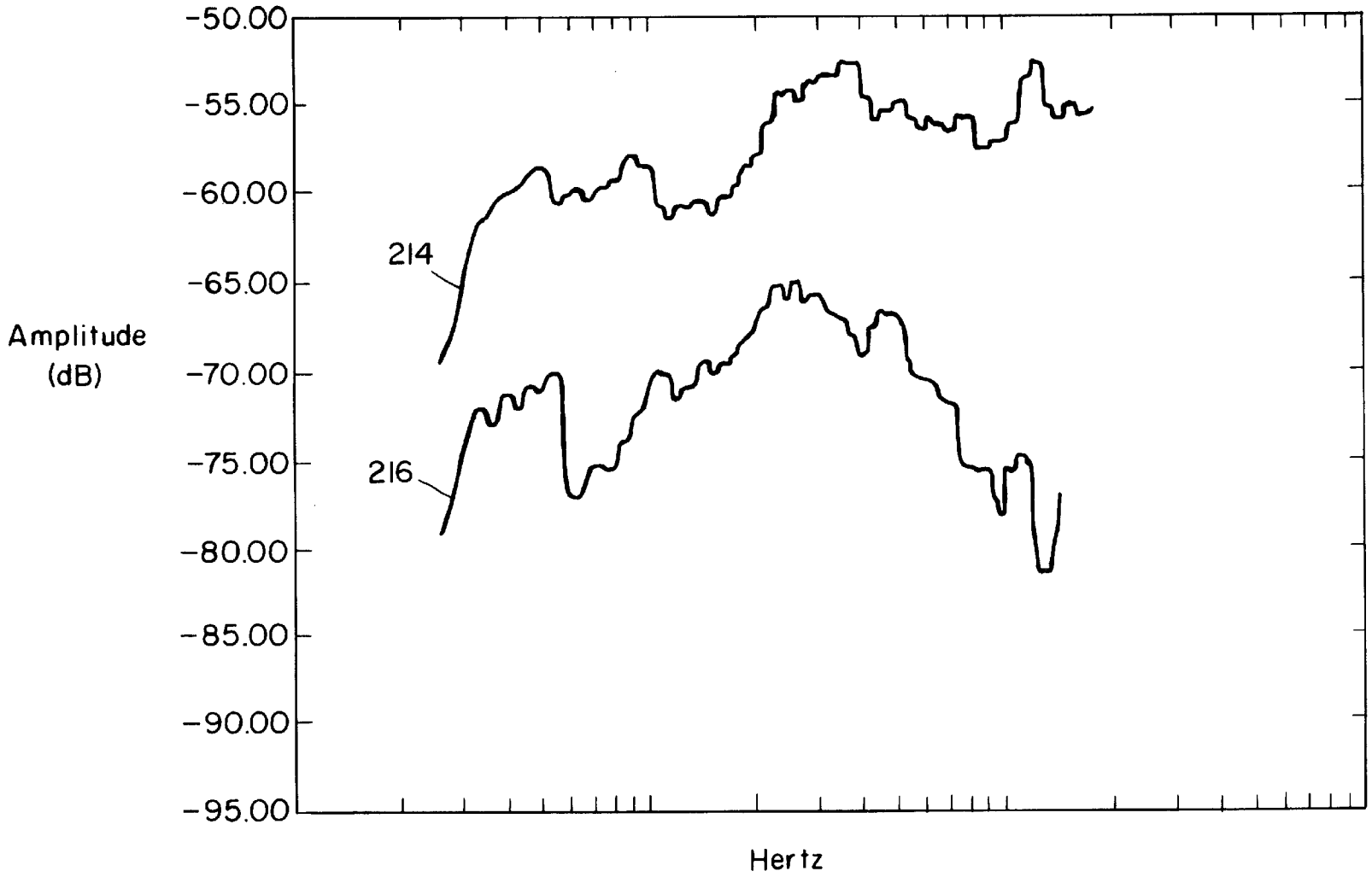

Referring to FIG. 15*b*, there is shown a graph of the measurement of the amplitude in dB of the sound radiated by loudspeaker unit 10R of FIG. 4, in directions 18R and 20 as a function of frequency. Curve 214 represents the amplitude of sound field radiated in direction 18R, while curve 216 represents the amplitude of the sound field radiated in direction 20. In both FIGS. 14*a* and 14*b*, at substantially all frequencies, the amplitude of the sound field is at least 10 dB greater in directions 18L and 18R, respectively, than in direction 20.

Figure 16A:
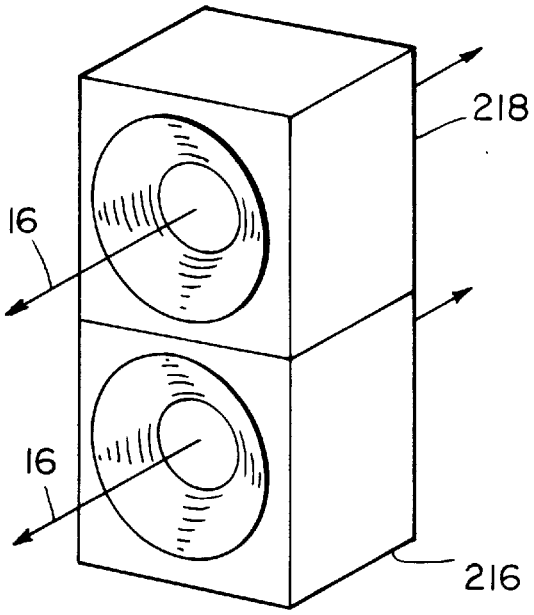
FIG. 16 is an isometric view of another loudspeaker system according to the invention.
Figure 16B:
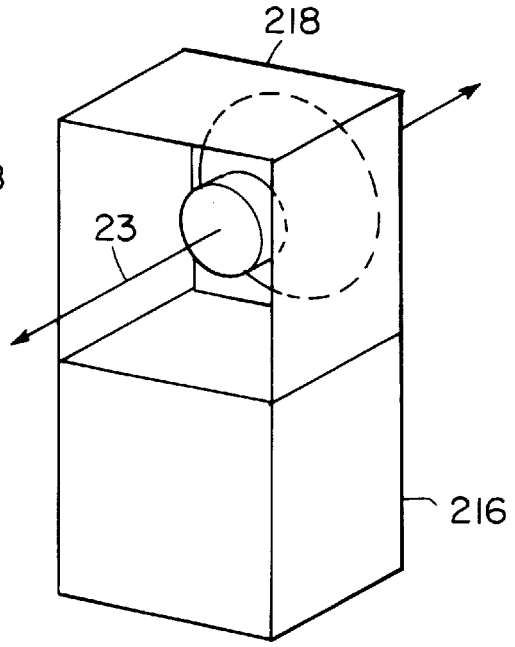

Referring to FIGS. 16*a* and 16*b* there are shown front and back perspective views of another embodiment of the invention. A first transducer 217 is sealed in an enclosure and radiates sound waves omnidirectionally at low and middle range frequencies. A second transducer 218 facing the same direction as the first transducer 217 is positioned in close proximity to first transducer 217, for example, above first transducer 217. Second transducer 218 is an open-backed dipole that radiates sound waves in direction 18 and in direction 23 opposite direction 18. First and second transducers 217 and 218 are both coupled to an audio signal source, not shown in this view.

Figure 17:
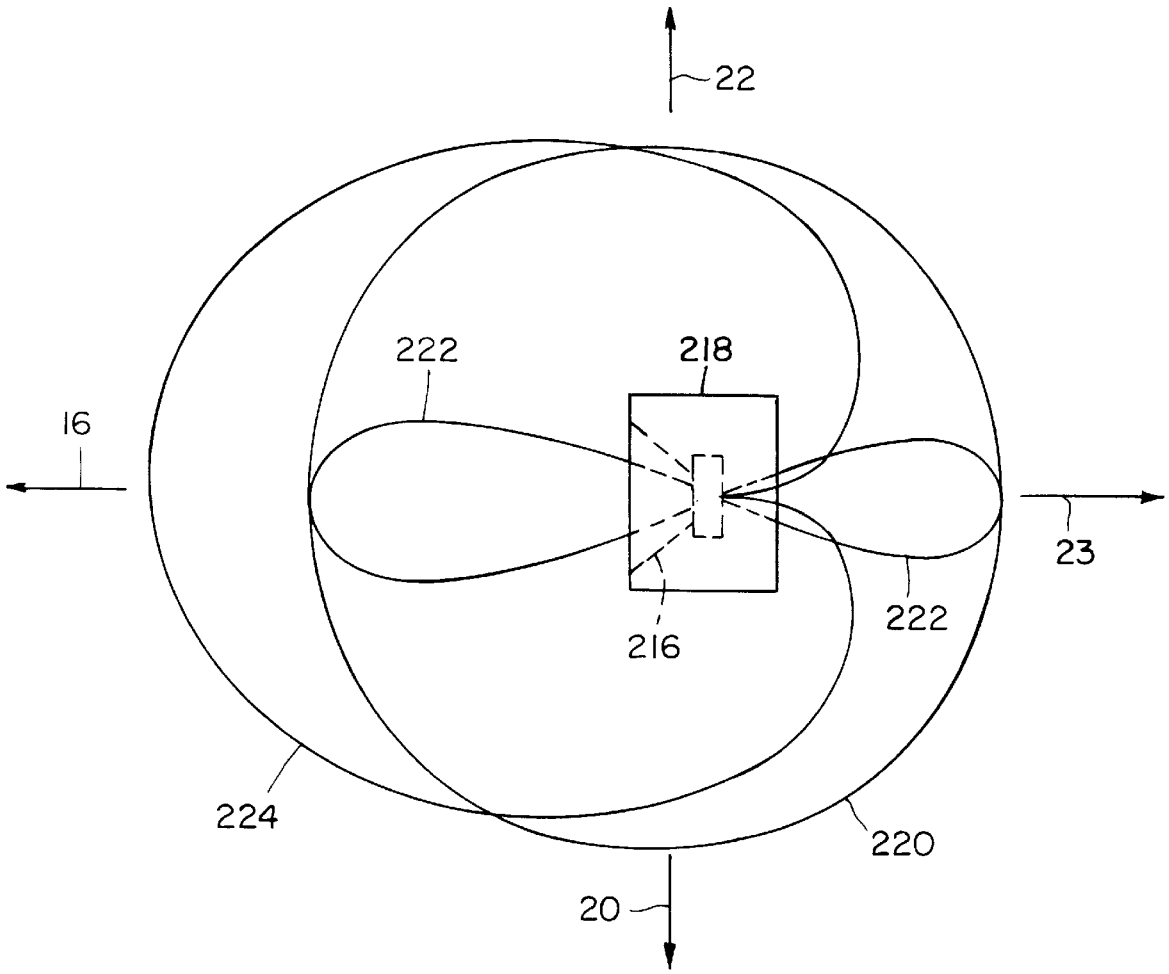
FIG. 17 is a polar plot of the sound field of a loudspeaker according to FIG. 16.

Referring to FIG. 17, there is shown a top diagrammatic view of the polar patterns of the sound fields radiated by the arrangement of FIG. 16. First transducer 217 radiates sound substantially omnidirectionally, as indicated by sound field polar pattern 220. Second transducer 218 (shown in dotted line in this view) radiates sound waves directionally characterized by a sound field figure-of-eight polar pattern 222. In direction 18, the sound fields 220 and 222 add; in direction 23 they oppose, and in directions 20 and 22 there is no contribution from sound field 222. As a result the combined sound field 224 is in the order of 6 dB greater than the sound field 220 in direction 18 the same as sound field 220 in direction 18 than in directions 20 and 22, and there is a null in direction 23; corresponding to a cardioid pattern.

Referring again to FIG. 2, if the arrangement of FIGS. 16 and 17 is incorporated in the embodiment of FIG. 2, the 6 dB decrease in directions 20 and 22 may be sufficient in many situations to cause a listener 34 of FIG. 2 to localize on the sound radiated in direction 18 and reflected off reflecting surface 36.

Figure 18A:
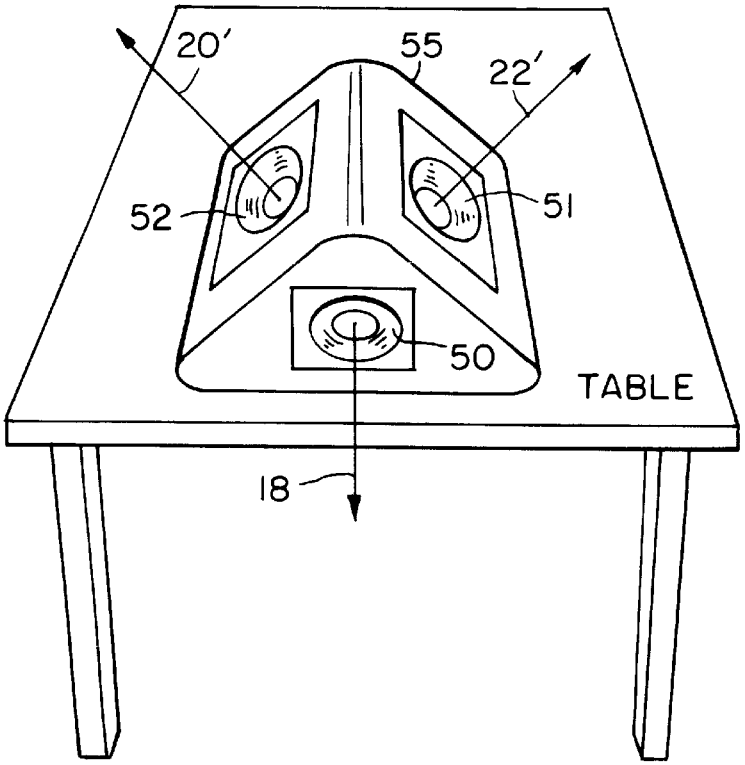
FIGS. 18*a* and 18*b* are perspective and partial elevation views respectively, of another embodiment of the invention.
Figure 18B:
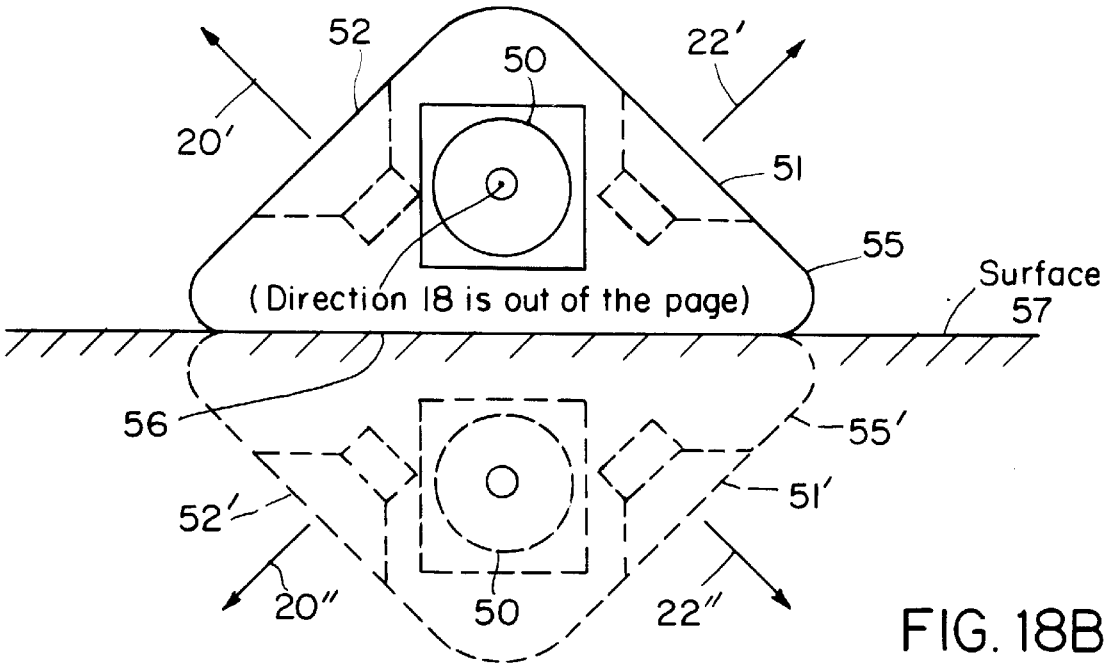

Referring to FIGS. 18*a* and 18*b*, there are shown perspective and partial elevation views, respectively, of another embodiment of the invention, comprising a loudspeaker unit 55 of triangular cross section. Unit 55 carries front transducer 55 and left and right side transducers 51 and 52, respectively. If the loudspeaker unit 55 is placed with its bottom surface 56 adjacent to a boundary surface 57, such as a wall or table, the interaction of loudspeaker unit 55 with surface 57 may be modelled with a virtual source mirror image of the loudspeaker unit, 55'. As is well known by those skilled in the art, mirror image transducers 50', 51' and 52' can simulate the first reflection behavior of transducers 50, 51 and 52, respectively, in surface 57. Thus, the sound waves radiated by transducers 50, 51 and 52 and reflected in surface 57 appear to originate from virtual transducers 50', 51' and 52', respectively. Similarly, reflected sound waves from virtual transducer 50' are opposed in directions 22" and 20" by sound waves radiated by virtual transducers 51' and 52', respectively. Thus, the combined sound waves radiation from first transducer 50 and virtual transducer 50' is radiated preferentially in direction 18 and largely cancelled in any direction orthogonal to their axes. Thus, the loudspeaker unit behaves similarly whether placed against a horizontal or vertical surface. This embodiment is useful in applications where sound wave radiation in only one direction or placement versatility is desired, such as surround sound loudspeakers for home theater.

Other embodiments are within the claims.

What is claimed is:

1. A loudspeaker system comprising, an input for receiving an audio electrical signal;

a first electroacoustical transducer constructed and arranged to radiate in a first direction for radiating first sound waves in a first frequency range in response to an audio electrical signal on said input;

a second electroacoustical transducer facing a second direction for radiating second sound waves;

a third transducer facing a third direction for radiating third sound waves;

a first low pass filter and a delay circuit coupling said input with said second transducer and said third transducer;

said first low pass filter for providing modified audio signals to said second transducer and to said third transducer, said delay circuits constructed and arranged so that said second sound waves are substantially out of phase with said first sound waves radiated in said second direction to buck said first sound waves in said second direction and so that said third sound waves are substantially out of phase with said first sound waves radiated in said third direction to buck said first sound waves in said third direction.

2. A loudspeaker system in accordance with claim 1, wherein said delay circuit comprises a frequency dependent phase shifter.

3. A loudspeaker system in accordance with claim 1 wherein said first transducer has a first radiating surface, said second transducer has a second radiating surface separated from the first radiating surface by an acoustic path and said delay circuit furnishes a delay approximately equal to a length of time required for sound waves to travel the length of said acoustic path.

4. A loudspeaker system in accordance with claim 1, wherein said second transducer and said first transducer are oriented substantially in space quadrature.

5. A loudspeaker system in accordance with claim 1 and further comprising a reflecting surface generally perpendicular to said first direction and constructed and arranged to coact with said first transducer to reflect sound energy radiated by said first transducer.

6. A directional loudspeaker system comprising, a first loudspeaker having a substantially dipole sound radiation pattern in a predetermined frequency range;

a second loudspeaker having a substantially omnidirectional sound radiation pattern in said frequency range;

wherein said first loudspeaker and said second loudspeaker are constructed and arranged so that radiation from said first and second loudspeakers cumulatively combine in a first direction and differentially combine in a second direction opposite to said first direction.

7. A directional loudspeaker in accordance with claim 6, wherein said first loudspeaker comprises a transducer having front and back radiating surfaces further comprising, a first enclosure for said first transducer having two opposing open faces, said first transducer disposed in said first enclosure so that said front and back radiating surfaces face respective ones of said open faces.

8. A directional loudspeaker in accordance with claim 7 wherein said second loudspeaker comprises a transducer having front and back radiating surfaces and further comprising, a second enclosure for said second transducer having one open face, said second transducer disposed in said second enclosure so that one of said radiating surfaces faces said open face, said first and second enclosures being contiguous.

9. Multichannel audio reproduction apparatus, comprising, an enclosure;

a first audio channel signal input;

a first transducer disposed in said enclosure and coupled to said first audio channel signal input for radiating first sound waves in response to a signal on said first audio channel signal input;

a second transducer disposed in said enclosure for radiating second sound waves;

a first signal modifier intercoupling said first audio channel signal input and said second transducer for providing a modified first signal to said second transducer such that said second sound waves substantially buck said first sound waves in a first direction;

a second audio channel signal input;

a third transducer disposed in said enclosure and coupled to said second audio channel signal input for radiating third sound waves in response to a signal on said second audio channel signal input;

a fourth transducer, disposed in said enclosure for radiating fourth sound waves;

a second signal modifier intercoupling said second audio channel signal input and said fourth transducer for providing a modified second signal to said fourth transducer such that said fourth sound waves buck said second sound waves in said first direction.

10. Multichannel audio reproduction apparatus in accordance with claim 9 wherein said first signal modifier comprises a low pass filter so that said second transducer operates over a different range of frequencies than said first transducer.

11. Multichannel audio reproduction apparatus in accordance with claim 10 wherein said different range of frequencies has an upper limit corresponding substantially to an upper limit of a range of frequencies in which said first transducer radiates sound substantially omnidirectionally.

12. Multichannel audio reproduction apparatus in accordance with claim 10 wherein said first transducer has a radiating surface having a circumference and wherein said low pass filter has a break frequency, said break frequency having a corresponding wavelength on the order of two times said circumference.

13. Multichannel audio reproduction apparatus in accordance with claim 9 wherein said first signal modifier comprises a phase shifter.

14. Multichannel audio reproduction apparatus in accordance with claim 13 wherein said phase shifter shifts a phase of said first channel signal by an amount proportional to a frequency of said signal.

15. Multichannel audio reproduction apparatus in accordance with claim 9 wherein said first direction is generally orthogonal to a second direction faced by said first transducer.

16. Multichannel audio reproduction apparatus in accordance with claim 15 and further comprising, a fifth transducer for radiating fifth sound waves, said fifth transducer disposed in said enclosure facing a third direction generally opposite a direction faced by said second transducer and orthogonal to said second direction, said fifth transducer coupled to said first signal modifier such that said fifth sound waves buck said first sound waves radiated in said third direction.

17. Multichannel audio reproduction apparatus in accordance with claim 16 wherein said third direction is substantially opposite said first direction.

18. Multichannel audio reproduction apparatus in accordance with claim 16 and further comprising, a sixth transducer for radiating sixth sound waves, said sixth transducer disposed in said enclosure facing a fourth direction generally opposite a direction faced by said fourth transducer and orthogonal to the direction said third transducer faces, said fifth transducer coupled to said second signal modifier such that said fifth sound waves buck said third sound waves radiated in said fourth direction.

19. Multichannel audio reproduction apparatus in accordance with claim 18 and further comprising a room having a listening location embracing said enclosure, wherein said first direction is substantially toward said listening location.

20. Multichannel audio reproduction system, comprising, a first transducer, a second transducer, a first audio channel signal input coupled to said first transducer so that said first transducer radiates first sound waves in response to a signal on said first audio channel signal input;

a second audio channel signal input coupled to said second transducer so that said second transducer radiates second sound waves in response to a signal on said second audio channel signal input;

a third transducer, a first signal modifier intercoupling said first audio channel signal input and said third transducer for providing a modified first channel signal to said third transducer;

a second signal modifier intercoupling said second audio channel signal input and said third transducer for providing a modified second channel signal to said third transducer;

wherein said third transducer radiates third sound waves that buck in a first direction said first sound waves and said second sound waves.

21. Multichannel audio reproduction system in accordance with claim 20 and further comprising a room embracing said multichannel audio reproduction system and having a listening location, wherein said first direction is substantially toward said listening location.

22. Multichannel audio reproduction system in accordance with claim 20 wherein said first signal modifier comprises a low pass filter.

23. Multichannel audio reproduction system in accordance with claim 20 wherein said first signal modifier comprises a frequency dependent phase shifter.

24. Multichannel audio reproduction system in accordance with claim 20 and further comprising, a third audio channel signal input coupled to said third transducer, wherein said third sound waves are representative of a signal on said third audio channel signal input, said modified first channel signals and said modified second channel signals; and a third signal modifier intercoupling said third audio channel signal input and said first transducer for providing a modified third channel signal to said first transducer, wherein said first transducer radiates sound waves responsive to signals on said first audio channel signal input and sound waves that buck in a second direction, sound waves radiated by said third transducer.

25. Multichannel audio reproduction system comprising, a first source of a first channel signal, a first transducer facing a first direction coupled to said first source so that said first transducer radiates sound waves representative of said first channel signal;

a second source of a second channel signal, a second transducer facing a second direction coupled to said second source so that said second transducer radiates sound waves representative of said second channel signal, a first signal modifier intercoupling said first source and said second transducer for providing a modified first channel signal to said second transducer such that said second transducer radiates sound waves that are representative of said first channel signal and that substantially reduce the amplitude of sound waves representative of said first channel signal radiated by said first transducer in said second direction.

26. Multichannel audio reproduction system in accordance with claim 25 wherein said first signal modifier comprises a low pass filter.

27. Multichannel audio reproduction system in accordance with claim 25 wherein said first signal modifier comprises a frequency dependent phase shifter.

28. A loudspeaker system comprising, an audio input for receiving an audio signal;

a housing;

a first transducer mounted in said housing, facing a first direction coupled to said audio input for radiating first sound waves representative of said audio signal;

a second transducer mounted in said housing facing a second direction for radiating second sound waves;

a delay circuit coupling said audio input to said second transducer delaying said audio signal so that said second waves are substantially out of phase with said first sound waves radiated in said second direction to oppose radiation of said first sound waves in said second direction, wherein said housing is adapted to be mounted on an acoustically reflective surface, wherein an axis of said first transducer intersects an axis of said second transducer at an angle significantly different from 180°.

29. A loudspeaker system in accordance with claim 28 wherein said acoustically reflective surface is a wall.

30. A loudspeaker system in accordance with claim 28 wherein said housing is adapted to be mounted in a closed-backed cabinet.

31. A loudspeaker system in accordance with claim 28 wherein said first direction is directed laterally to an intended listening position.

32. A loudspeaker system in accordance with claim 28 wherein said second direction is directed toward an intended listening position.

33. Electroacoustical transducing apparatus comprising, an input for receiving an audio electrical signal, a first electroacoustical transducer constructed and arranged to radiate first sound waves in a first direction in a first frequency range in response to an audio electrical signal on said input, a second electroacoustical transducer constructed and arranged to radiate sound energy in a second direction in a second frequency range, a third electroacoustical transducer constructed and arranged to radiate sound energy in a third direction within said second frequency range, intercoupling circuitry intercoupling said input with said second transducer and said third transducer constructed and arranged to cause said second transducer and said third transducer to radiate sound energy in said second and third directions in response to an audio electrical signal on said input relatively phased with respect to energy radiated in said second frequency range by said first transducer in said second and third directions in phase opposition therewith to oppose radiation in second and third directions from said first transducer within said second frequency range, said first frequency range being greater than and embracing said second frequency range.

34. Electroacoustical transducing apparatus in accordance with claim 33 wherein said intercoupling circuitry includes a low pass filter intercoupling said input and said first and third transducers constructed and arranged to selectively transmit spectral components within said second frequency range from said input to said first and third transducers.

35. Electroacoustical transducing apparatus in accordance with claim 33 wherein said intercoupling circuitry includes a delay network constructed and arranged to furnish a delay to spectral components transmitted from said input to said second and third electroacoustical transducers related to the distance between said first electroacoustical transducer and said second and third electroacoustical transducers respectively so that sound energy from said first electroacoustical transducer radiated in said second and third directions arrives at said second and third electroacoustical transducers in phase opposition with respect to energy radiated by said second and third electroacoustical transducers respectively in said second and third directions respectively.

36. Electroacoustical transducing apparatus in accordance with claim 35 wherein said delay network comprises a frequency dependent phase shifter.

37. Electroacoustical transducing apparatus in accordance with claim 33 wherein said first and second directions are in substantial space quadrature.

38. Electroacoustical transducing apparatus in accordance with claim 37 and further comprising a room having walls surrounding a normal listening area, said electroacoustical transducing apparatus positioned in said room so that said first direction is toward a wall of said room and one of said second and third directions is directed to said normal listening area of said room to create virtual images outside said room so that a listener in said normal listening area perceives a sound image created by said electroacoustical transducing system that extends outside said room.

39. Electroacoustical transducing apparatus in accordance with claim 33 therein said first electroacoustical transducer is characterized by a substantially omnidirectional polar radiation pattern in said second frequency range and said second and third electroacoustical transducers comprise an acoustic dipole to oppose sound energy radiated by said first electroacoustical transducer in said second direction and augment radiation from said first electroacoustical transducer in said first direction.

40. Electroacoustical transducing apparatus comprising, a first electroacoustical transducer that is an acoustic dipole and characterized by a figure-of-8 radiation pattern having first and second oppositely phased lobes in a first frequency range, and a second electroacoustical transducer having a substantially omnidirectional radiation pattern in said first frequency range and co-acting with said first electroacoustical transducer for providing cumulative combination with sound energy in one of said lobes and differential combination with sound energy in the other of said lobes.

41. Electroacoustical transducing apparatus in accordance with claim 40 wherein said first electroacoustical transducer comprises a loudspeaker driver having a vibratable diaphragm with a front surface and a back surface, and a first enclosure supporting said first transducer constructed and arranged to allow radiation from both said front and back surfaces.

42. Electroacoustical transducing apparatus in accordance with claim 41 wherein said second electroacoustical transducer comprises a loudspeaker driver having a vibratable diaphragm and further comprising, a second enclosure supporting said second electroacoustical transducer constructed and arranged to allow radiation from only one of said front and rear surfaces.

43. Multichannel audio reproduction system in accordance with claim 25 and further comprising, a second signal modifier intercoupling said second source and said first transducer for providing a modified second channel signal to said first transducer such that said first transducer radiates sound waves that are representative of said second channel signal and that substantially reduce the amplitude of sound waves representative of said second channel signal radiated by said second transducer in said first direction.

44. A multichannel audio reproduction system comprising, a plurality of audio signal channels each associated with a corresponding direction of radiation, a corresponding plurality of electroacoustical transducers each having a maximum of radiation in a corresponding one of said radiation directions coupled to the audio signal channel associated with said direction of radiation, a corresponding plurality of signal modifiers each coupling a respective audio signal channel to at least one other of said electroacoustical transducers associated with a different direction, said multichannel audio reproduction system constructed and arranged so that radiation from each of said electroacoustical transducers is opposed by radiation from at least one other of said electroacoustical transducers in all but the maximum radiation direction of each transducer.

* * * * *